US007259642B2

(12) United States Patent
Kirino

(10) Patent No.: US 7,259,642 B2
(45) Date of Patent: Aug. 21, 2007

(54) ANTENNA CONTROL UNIT AND PHASED-ARRAY ANTENNA

(75) Inventor: Hideki Kirino, Kagawa (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/515,482

(22) PCT Filed: Jun. 13, 2003

(86) PCT No.: PCT/JP03/07540

§ 371 (c)(1),
(2), (4) Date: Nov. 24, 2004

(87) PCT Pub. No.: WO03/107480

PCT Pub. Date: Dec. 24, 2003

(65) Prior Publication Data

US 2006/0038634 A1 Feb. 23, 2006

(30) Foreign Application Priority Data

Jun. 13, 2002 (JP) ..... 2002-172424

(51) Int. Cl.
*H01P 5/12* (2006.01)
*H01P 9/00* (2006.01)
*H01Q 21/00* (2006.01)

(52) U.S. Cl. ..... 333/164; 333/100; 343/853

(58) Field of Classification Search ..... 333/164, 333/100, 117
See application file for complete search history.

(56) References Cited

U.S. PATENT DOCUMENTS 5,589,845 A 12/1996 Yandrofski et al.
5,734,349 A 3/1998 Lenormand et al.
6,070,090 A 5/2000 Feuerstein
6,285,337 B1 9/2001 West et al.
6,377,142 B1 4/2002 Chiu et al.
6,456,236 B1 9/2002 Hauck et al.
6,496,147 B1 * 12/2002 Kirino ..... 343/700 MS

FOREIGN PATENT DOCUMENTS

| | | |
|---|---|---|
| EP | 1 137 100 A2 | 9/2001 |
| EP | 1 150 380 A1 | 10/2001 |
| GB | 1 594 989 | 8/1981 |
| JP | 4-261022 | 9/1992 |
| JP | 9-172303 | 6/1997 |
| JP | 2000-236207 | 8/2000 |

* cited by examiner

*Primary Examiner*—Robert Pascal
*Assistant Examiner*—Kimberly E Glenn
(74) *Attorney, Agent, or Firm*—Wenderoth, Lind & Ponack, L.L.P.

(57) ABSTRACT

A paraelectric transmission line layer and a ferroelectric transmission line layer are laminated through a ground conductor, and plural phase shifters, which are connected via through holes that pass through the ground conductor, are disposed on both of the transmission line layers at some positions on a feeding line that branches off from the input terminal between all antenna terminals and an input terminal to which a high-frequency power is applied. In addition, loss elements each having the same transmission loss amount as the phase shifter, or the phase shifters are disposed so that transmission loss amounts from all of the antenna terminals to the input terminal are equalized. Accordingly, an antenna control unit which can be manufactured in fewer manufacturing processes and has a pointed beam and a large beam tilt amount, and a phased-array antenna that employs such an antenna control unit are provided.

16 Claims, 10 Drawing Sheets

Fig.7

$$M_k = M_{k-1} \times 2 + 2^{k-1} \text{ (when } k \geqq 1, M1 = 1)$$

| the number of branch stages k | the number of antenna elements m | the number of phase shifters $M_k$ |
|---|---|---|
| 1 | 2 | 1 |
| 2 | 4 | 4 |
| 3 | 8 | 12 |

k=1, m=2 k=2, m=4 k=3, m=8

ANTENNA CONTROL UNIT AND PHASED-ARRAY ANTENNA

TECHNICAL FIELD

The present invention relates to an antenna control unit that employs a ferroelectric as a phase shifter, and a phased-array antenna that utilizes such an antenna control unit. More particularly, the present invention relates to an antenna control unit such as mobile unit identifying radio or automobile collision avoidance radar, and a phased-array antenna that utilizes such an antenna control unit.

BACKGROUND ART

Systems such as "Active phased-array antenna and antenna control unit" described in Japanese Published Patent Application No. 2000-236207 (hereinafter, referred to as Prior Art 1) have been suggested as examples of conventional phased-array antennas that employ a ferroelectric as a phase shifter.

Hereinafter, a conventional phased-array antenna will be described with reference to FIGS. 9 and 10.

Initially, operating principles of a conventional phase shifter are described with reference to FIGS. 9(*a*) and 9(*b*). FIGS. 9(*a*) and 9(*b*) are diagrams illustrating a phase shifter 700 that is suggested in the conventional phased-array antenna. FIG. 9(*a*) is a diagram illustrating a construction of the phase shifter 700, and FIG. 9(*b*) is a diagram showing permittivity changing characteristics of a ferroelectric material.

This phase shifter 700 includes a microstrip hybrid coupler 703 that employs a paraelectric material 701 as a base material, and a microstrip stub 704 that employs a ferroelectric material 702 as a base material and is formed adjacent to the microstrip hybrid coupler 703. This phase shifter 700 is constituted such that a phase shift amount of a high-frequency power that passes through the microstrip hybrid coupler 703 varies according to a DC control voltage which is applied to the microstrip stub 704.

In other words, the base material of the phase shifter 700 is composed of the paraelectric material 701 and the ferroelectric material 702. A rectangular loop-shaped conductor layer 703*a* is disposed on the paraelectric base material 701, and this loop-shaped conductor layer 703*a* and the paraelectric base material 701 form the microstrip hybrid coupler 703.

Further, two linear conductor layers 704*a*1 and 704*a*2 are disposed on the ferroelectric base material 702 so as to be located on extension lines of two opposed linear parts 703*a*1 and 703*a*2 of the rectangular loop-shaped conductor layer 703*a* and linked to one of the ends of the two linear parts 703*a*1 and 703*a*2, respectively. These two linear conductor layers 704*a*1 and 704*a*2 and the ferroelectric base material 702 form the microstrip stub 704.

Further, conductor layers 715*a* and 720*a* are disposed on the paraelectric base material 701 so as to be located on extension lines of the two linear parts 703*a*1 and 703*a*2 and linked to the other ends of the two linear parts 703*a*1 and 703*a*2, respectively.

This conductor layer 715*a* and the paraelectric base material 701 form an input line 715, and the conductor layer 720*a* and the paraelectric base material 701 form an output line 720.

Here, the one end and the other end of the linear part 703*a*1 on the loop-shaped conductor layer 703*a* are ports 2 and 1 of the microstrip hybrid coupler 703, respectively. On the other hand, the one end and the other end of the linear parts 703*a*2 of the loop-shaped conductor layer 703*a* are ports 3 and 4 of the microstrip hybrid coupler 703, respectively.

In the phase shifter 700 having the above-mentioned construction, when the DC control voltage is applied to the microstrip stub 704, the phase shift amount of the high-frequency power that passes therethrough varies.

Hereinafter, a detailed explanation of the phase shifter 700 will be given. In the phase shifter 700 having such a construction in which one reflection element (microstrip stub 704) is connected to the adjacent two ports (ports 2 and 3) of the properly-designed microstrip hybrid coupler 703, a high-frequency power that enters from the input port (port 1) is not outputted from the input port 1, but the high-frequency power upon which a power reflected from the reflection element has been reflected is outputted only from the output port (port 4). In the reflection from the microstrip stub 704 as the reflection element, a bias field 705 that is produced by the control voltage is in the same direction as that of a field produced by the high-frequency power that passes through the microstrip stub 704, as shown in FIG. 9(*a*). Therefore, as shown in FIG. 9(*b*), when the control voltage is changed, an effective permittivity of the microstrip stub 704 with respect to the high-frequency power varies adaptively. Accordingly, the equivalent electrical length of the microstrip stub 704 for the high-frequency power varies, and the phase on the microstrip stub 704 is changed.

In the case of common ferroelectric base materials, the bias voltage 705 that is required to change the effective permittivity of the microstrip stub 704 is in a rage of several kilovolts/millimeter to a dozen kilovolts/millimeter. Accordingly, a high frequency is not produced by the effective permittivity that is affected by a field formed by the high-frequency power which passes through the microstrip stub 704.

Next, a construction of the conventional phased-array antenna and its operating principles will be described with reference to FIGS. 10(*a*) and 10(*b*).

FIG. 10(*a*) is a diagram illustrating a construction of the conventional phased-array antenna 830, and FIG. 10(*b*) is a diagram showing directivities of the conventional phased-array antenna 830 in a case where a beam tilt voltage is applied and a case where the beam tilt voltage is not applied.

The conventional phased-array antenna 830 comprises plural antenna elements 806*a*-806*d* which are placed in a row at regular intervals on a dielectric base material, an antenna control unit 800, and a beam tilt voltage 820. The antenna control unit 800 comprises a feeding terminal 808 to which a high-frequency power is applied (hereinafter, referred to as an input terminal), a high frequency blocking element 809, and plural phase shifters 807*a*1-807*a*4.

In this conventional phased-array antenna 830, the antenna element 806*a* is connected to the input terminal 808, the antenna element 806*b* is connected to the input terminal 808 through one phase shifter 807*a*1, the antenna element 806*c* is connected to the input terminal 808 through two phase shifters 807*a*3 and 807*a*4, and the antenna element 806*d* is connected to the input terminal 808 through three phase shifters 807*a*2, 807*a*3, and 807*a*4, by means of a feeding line (hereinafter, referred to as a transmission line), respectively. The beam tilt voltage 820 is connected to the input terminal 808 through the high frequency blocking element 809.

It is assumed here that each construction of the phase shifters 807$a$1-807$a$4 is the same as that described with reference to FIG. 9, and the phase shifters 807$a$1-807$a$4 have the same characteristics.

In the phased-array antenna 830 having the above construction, the number of phase shifters 807 which are located between one of the antenna elements 806$a$-806$d$ and the input terminal 808 is one larger than the number of phase shifters 807 which are located between the adjacent antenna element 806 and the input terminal 808, respectively, and further, all of the phase shifters 807 have the same characteristics. Therefore, as shown in FIG. 10($b$), the control of the antenna's directivity (beam tilt) is performed by one beam tilt voltage 820.

The control of the antenna directivity will be described in more detail. For example, assuming that each of the phase shifters 807$a$1-807$a$4 delays the phase of the high-frequency power that passes through each phase shifter by a phase shift amount Φ and the adjacent phase shifters 807 are spaced by a distance d, respectively, the high-frequency power that has entered the antenna element 806$a$ is supplied to the input terminal 808 with no phase change, as shown in FIG. 10($a$). In contrast to this, the high-frequency power that has entered the antenna element 806$b$ is supplied to the input terminal 808, with its phase being delayed by the phase shifter 807$a$1 by a phase shift amount Φ. The high-frequency power that has entered the antenna element 806$c$ is supplied to the input terminal 808, with its phase being delayed by the phase shifters 807$a$3 and 807$a$4, by a phase shift amount 2Φ. Further, the high-frequency power that has entered the antenna element 806$d$ is supplied to the input terminal 808, with its phase being delayed by the phase shifters 807$a$2, 807$a$3, and 807$a$4, by a phase shift amount 3Φ.

In other words, a direction of the maximum sensitivity for radio waves received by the antenna elements 806$a$-806$d$ is a direction D that forms a predetermined angle $\Theta(\Theta=\cos^{-1}(\Phi/d))$ with respect to the direction of the row of the antenna elements 806$a$-806$d$. It is assumed here that reference numerals w1 to w3 in FIG. 10($a$) denote planes of the received waves in the same phase, respectively.

However, in the conventional phased-array antenna 803 having the above-mentioned construction, the numbers of phase shifters 807 which are located between the respective antenna elements 806 and the input terminal 808 are different, and further, there are transmission losses in the respective phase shifters 807. Therefore, the effects of combining powers from the respective antenna elements 806$a$-806$d$ are decreased, so that the shape of the beam that is shown in FIG. 10($b$) is deformed, whereby it is difficult to obtain a pointed beam (large directivity gain). In addition, the amount of beam tilt is reduced, and as a result, the control of the antenna's directivity is deteriorated.

Further, as described with reference to FIG. 9($a$), each of the phase shifters 807 that are used for the conventional phased-array antenna 830 is formed in one piece, by allocating areas on the same plane to the ferroelectric base material 702 and the paraelectric base material 701 which constitute the phase shifter 700, respectively. Therefore, a distributed capacitance Cn per unit length of the line for the microstrip hybrid coupler 703 and a distributed capacitance Cf per unit length of the line for the microstrip stub 704 are greatly different from each other. Accordingly, high-frequency power reflection is produced at the connection between the microstrip hybrid coupler 703 and the microstrip stub 704, whereby the power from the microstrip hybrid coupler 703 does not enter the microstrip stub 704 so efficiently, and consequently, the sufficient phase shift amount cannot be obtained.

Hereinafter, a detailed explanation will be given. For, example, the line impedance Z is generally expressed by the distributed inductance L per unit length of the line and the distributed capacitance C per unit length of the line as Z^2 (the square of Z)=L/C. Further, when it is assumed that all fields exist only within the base material, and all of the fields are approximated to be linear and perpendicular to the ground conductor, the distributed capacitance C per unit length of the line is expressed by the line width W, the base material thickness H, and the base material permittivity ϵ, as C=ϵW/H. When the distributed capacitance Cn per unit length of the line for the microstrip hybrid coupler 703 and the distributed capacitance Cf per unit length of the line for the microstrip stub 704 are compared with each other by utilizing the above-mentioned expressions, assuming that the permittivity of the paraelectric base material 701 as the base material of the microstrip hybrid coupler 703 is ϵn and the permittivity of the ferroelectric base material 702 as the base material of the microstrip stub 704 is ϵf, the relationship ϵn<<ϵf is generally established. Further, since the line widths W of the microstrip hybrid coupler 703 and the microstrip stub 704, and the distances H of the respective conductors are the same, the distributed capacitance Cn per unit length of the line for the microstrip hybrid coupler 703 (=ϵnW/H) and the distributed capacitance Cf per unit length of the line for the microstrip stub 704 (=ϵfW/H) are greatly different. Consequently, as mentioned above, the power from the microstrip hybrid coupler 703 does not enter the microstrip stub 704 so efficiently, and thus, the sufficient phase shift amount cannot be obtained.

To overcome this problem, the method in which a magnetic material is provided in proximity of the microstrip stub 704 to increase the distributed inductance L per unit length of the line for the microstrip stub 704, thereby enhancing the line impedance Z, is disclosed in the above-mentioned Prior Art 1, and its construction is also suggested therein.

However, when the magnetic material is provided in proximity of the microstrip stub 704 of the phase shifter 700 to suppress the reduction in the matching degree of the line impedance Z between both the line sections 703 and 704, so as to obtain a larger phase shift amount, as in the above-mentioned Prior Art 1, there arises an additional problem in that more processes are needed when the phase shifter 700 is produced by firing. As a result, the manufacturing cost of the phase shifter is adversely increased.

The present invention is made to solve the above-mentioned problems. Accordingly, an object of the present invention is to provide an antenna control unit that can be manufactured in fewer manufacturing processes (low cost), and has a pointed beam (large directivity gain) and a large amount of beam tilt, and a phased-array antenna that employs such an antenna control unit.

SUMMARY OF THE INVENTION

According to a first aspect of the present invention, there is provided an antenna control unit including plural antenna terminals to which antenna elements are connected, a feeding terminal to which a high-frequency power is applied, and phase shifters which are connected to the respective antenna terminals by feeding lines that branch off from the feeding terminal and electrically change a phase of a high-frequency signal that passes through between the respective antenna terminals and the feeding terminal. The phase shifters are placed at some positions on the respective feeding lines, and the phase shifters include a hybrid coupler on a paraelectric transmission line layer that employs a paraelectric material as a base material, and a stub on a ferroelectric transmission line layer that employs a ferroelectric material as a base material. The paraelectric transmission line layer and the ferroelectric transmission line layer are laminated through a ground conductor, and the hybrid coupler and the stub are connected via a through hole that passes through the ground conductor. Further, a distance between conductors that form a transmission line on the ferroelectric transmission line layer is larger than a distance between conductors that form a transmission line on the paraelectric transmission line layer.

Therefore, it is possible to obtain a low-cost phase shifter which provides an effective phase shift amount and is manufactured in few processes. Consequently, an antenna control unit can be manufactured in few processes, whereby the manufacturing cost of the antenna control unit can be reduced.

According to a second aspect of the present invention, there is provided an antenna control unit including plural antenna terminals to which antenna elements are connected, a feeding terminal to which a high-frequency power is applied, and phase shifters which are connected to the respective antenna terminals by feeding lines that branch off from the feeding terminal and electrically change a phase of a high-frequency signal that passes through between the respective antenna terminals and the feeding terminal. The phase shifters are placed at some positions on the respective feeding lines, and the phase shifters include a hybrid coupler on a paraelectric transmission line layer that employs a paraelectric material as a base material, and a stub on a ferroelectric transmission line layer that employs a ferroelectric material as a base material. The paraelectric transmission line layer and the ferroelectric transmission line layer are laminated through a ground conductor, and the hybrid coupler and the stub are electromagnetically connected via a coupling window that is formed on the ground conductor. Further, a distance between conductors that form a transmission line on the ferroelectric transmission line layer is larger than a distance between conductors that form a transmission line on a paraelectric transmission line layer.

Therefore, it is possible to obtain a lower-cost phase shifter that provides a more effective phase shift amount and is manufactured in fewer processes. Consequently, an antenna control unit can be manufactured in fewer processes, whereby the manufacturing cost of the antenna control unit can be reduced.

According to a third aspect of the present invention, there is provided a phased-array antenna that includes, on a dielectric substrate, plural antenna elements, and an antenna control unit having a feeding terminal to which a high-frequency power is applied. Phase shifters that are connected with the respective antenna elements by feeding lines which branch off from the feeding terminal and electrically change a phase of a high-frequency signal that passes through between the respective antenna elements and the feeding terminal are also provided. The phase shifters are placed at some positions on the feeding lines. The phase shifters include a hybrid coupler on a paraelectric transmission line layer that employs a paraelectric material as a base material, and a stub on a ferroelectric transmission line layer that employs a ferroelectric material as a base material. The paraelectric transmission line layer and the ferroelectric transmission line layer are laminated through a ground conductor, and the hybrid coupler and the stub are connected via a through hole that passes through the ground conductor. Further, a distance between conductors that form a transmission line on the ferroelectric transmission line layer is larger than a distance between conductors that form a transmission line on the paraelectric transmission line layer.

Therefore, it is possible to obtain a low-cost phase shifter that provides an effective phase shift amount and is manufactured in few processes. Consequently, a phased-array antenna can be manufactured in few processes, whereby the manufacturing cost of the phased-array antenna can be reduced.

According to a fourth aspect of the present invention, there is provided a phased-array antenna that includes, on a dielectric substrate, plural antenna elements, and an antenna control unit having a feeding terminal to which a high-frequency power is applied. Phase shifters that are connected with the respective antenna elements by feeding lines which branch off from the feeding terminal and electrically change a phase of a high-frequency signal that passes through between the respective antenna elements and the feeding terminal are also provided. The phase shifters are placed at some positions on the feeding lines. The phase shifters include a hybrid coupler on a paraelectric transmission line layer that employs a paraelectric material as a base material, and a stub on a ferroelectric transmission line layer that employs a ferroelectric material as a base material. The paraelectric transmission line layer and the ferroelectric transmission line layer are laminated through a ground conductor, and the hybrid coupler and the stub are electromagnetically connected via a coupling window that is formed in the ground conductor. Further, a distance between conductors that form a transmission line on the ferroelectric transmission line layer is larger than a distance between conductors that form a transmission line on the paraelectric transmission line layer.

Therefore, it is possible to obtain a low-cost phase shifter that provides a more effective phase shift amount and is manufactured in fewer manufacturing processes. Consequently, a phased-array antenna can be manufactured in few processes, whereby the manufacturing cost of the phased-array antenna can be reduced.

According to a fifth aspect of the present invention, there is provided an antenna control unit including: a feeding terminal to which a high-frequency power is applied; a feeding line that branches off into m lines at a k-th branch stage from the feeding terminal when m=2^k (k-th power of 2) (m, k is an integer); m antenna terminals for connecting antenna elements, which are provided on ends of the m feeding lines and arranged in a row, where the antenna terminals are referred to as first, second, . . . , and m-th antenna terminals, respectively; $M_k$ phase shifters ($M_k=M_{(k-1)}\times 2+2^{(k-1)}$ when $k\geqq 1$ and $M_1=1$) which all have the same characteristics and electrically change a phase of a high-frequency signal that passes through the feeding line; and $M_k$ loss elements which all have the same characteristics and have a transmission loss amount that is equal to a transmission loss amount of the phase shifter. The phase shifters are placed at some positions on the feeding line that branch off into m lines, such that the number of phase shifters which are located between a (n+1)-th antenna terminal (n is an integer that is from 1 to m−1) and the feeding terminal is one larger than the number of phase shifters which are located between an n-th antenna terminal and the feeding terminal. The loss elements are placed at some positions on the feeding line that branch off into m lines, such that the transmission loss amount from the n-th antenna terminal to the feeding terminal is larger than the transmission loss amount from the (n+1)-th antenna terminal to the feeding terminal, by a transmission loss amount corresponding to one phase shifter.

Therefore, variation in the amounts of distributed power to the m antenna terminals is avoided, whereby deformation of the beam shape or reduction in the amount of changes in the beam direction can be avoided. Consequently, an antenna control unit that has a pointed beam (large directivity gain) and a satisfactory beam tilt amount can be realized.

According to a sixth aspect of the present invention, there is provided an antenna control unit including: a feeding terminal to which a high-frequency power is applied; a feeding line that branches off into m lines at a k-th branch stage from the feeding terminal when m=2^k (k-th power of 2) (m, k is an integer); m antenna terminals for connecting antenna elements, which are provided on ends of the m feeding lines and arranged in a row, where the antenna terminals are referred to as first, second, . . . , and m-th antenna terminals, respectively; $M_k$ positive beam tilting phase shifters ($M_k=M_{(k-1)}\times 2+2^{(k-1)}$ when $k\geqq 1$ and $M_1=1$) which all have the same characteristics and electrically change a phase of a high-frequency signal that passes through the feeding line in a positive direction; and $M_k$ negative beam tilting phase shifters which all have the same characteristics and electrically change the phase of the high-frequency signal that passes through the feeding line in a negative direction. The positive beam tilting phase shifters are placed at some positions on the feeding line that branch off into m lines, such that the number of the positive beam tilting phase shifters which are located between an (n+1)-th antenna terminal (n is an integer from 1 to m−1) and the feeding terminal is one larger than the number of the positive beam tilting phase shifters which are located between an n-th antenna terminal to the feeding terminal. The negative beam tilting phase shifters are placed at some positions on the feeding line that branches off into m lines, such that the number of negative beam tilting phase shifters which are located between an n-th antenna terminal to the feeding terminal is one larger than the number of negative beam tilting phase shifters which are located between an (n+1)-th antenna terminal to the feeding terminal.

Therefore, variation in the amounts of distributed power to the m antenna terminals is avoided, whereby deformation of the beam shape or reduction in the amount of changes in the beam direction can be avoided, and further, the reduction in the beam tilt amount can be avoided even when the phase shift amount of the phase shifter is small. Consequently, an antenna control unit that has a more pointed beam (larger directivity gain) and a more satisfactory beam tilt amount can be realized.

According to a seventh aspect of the present invention, there is provided a two-dimensional antenna control unit including $m_2$ row antenna control units and one column antenna control unit. The row antenna control units are the antenna control unit according to the fifth aspect including $m=m_1$ antenna terminals ($m_1$ is an integer). The column antenna control unit is the antenna control unit according to the fifth aspect including $m=m_2$ antenna terminals ($m_2$ is an integer). The feeding terminals of the $m_2$ row antenna control units are connected to the $m_2$ antenna terminals of the column antenna control unit, respectively.

Therefore, a two-dimensional antenna control unit that has a pointed beam (large directivity gain) as well as a satisfactory beam tilt amount, and that can implement X-axial and Y-axial beam tilt can be realized.

According to an eighth aspect of the present invention, there is provided a two-dimensional antenna control unit including $m_2$ row antenna control units and one column antenna control unit. The row antenna control units are the antenna control unit according to the sixth aspect including $m=m_1$ antenna terminals ($m_1$ is an integer). The column antenna control unit is the antenna control unit according to the sixth aspect including $m=m_2$ antenna terminals ($m_2$ is an integer). The feeding terminals of the $m_2$ row antenna control units are connected to the $m_2$ antenna terminals of the column antenna control unit, respectively.

Therefore, a two-dimensional antenna control unit that has a more pointed beam (larger directivity gain) and a more satisfactory beam tilt, and that can implement the X-axial and Y-axial beam tilt can be realized.

According to a ninth aspect of the present invention, in accordance with the phased-array antenna of the third aspect, the antenna control unit is the antenna control unit according to the fifth or sixth aspect.

Therefore, a two-dimensional antenna control unit that has a pointed beam (large directivity gain) as well as a satisfactory beam tilt amount can be manufactured in few processes, +thereby reducing the manufacturing cost.

According to a tenth aspect of the present invention, in accordance with the phased-array antenna of the third aspect, the antenna control unit is the antenna control unit according to the seventh or eighth aspect.

Therefore, a phased-array antenna that has a pointed beam (large directivity gain) as well as a satisfactory beam tilt amount, and that can implement X-axial and Y-axial beam tilt can be manufactured in few processes, thereby reducing the manufacturing cost.

According to an eleventh aspect of the present invention, in accordance with the phased-array antenna of the fourth aspect, the antenna control unit is the antenna control unit according to the fifth or sixth aspect.

There fore, a phased-array antenna that has a more pointed beam (larger directivity gain) as well as a more satisfactory beam tilt amount can be manufactured in few processes, thereby reducing the manufacturing cost.

According to a twelfth aspect of the present invention, in accordance with the phased-array antenna of the fourth aspect, the antenna control unit is the antenna control unit according to the seventh or eighth aspect.

Therefore, a phased-array antenna that has a more pointed beam (larger directivity gain) as well as a more satisfactory beam tilt amount and that can implement X-axial and Y-axial beam tilt can be manufactured in fewer processes, thereby reducing the manufacturing cost.

BRIEF DESCRIPTION OF THE DRAWINGS

FIG. 7 is a table showing the relationship of the number of branch stages (k), the number of antenna elements (m), and the number of phase shifters ($M_k$) in the antenna control unit or phased-array antenna according to the sixth embodiment.

DETAILED DESCRIPTION OF THE INVENTION

First Embodiment

Hereinafter, a first embodiment of the present invention will be described with reference to FIGS. 1(*a*) and 1(*b*).

In the first embodiment, a phase shifter that is employed for a phased-array antenna of the present invention will be described.

Figure 1A:
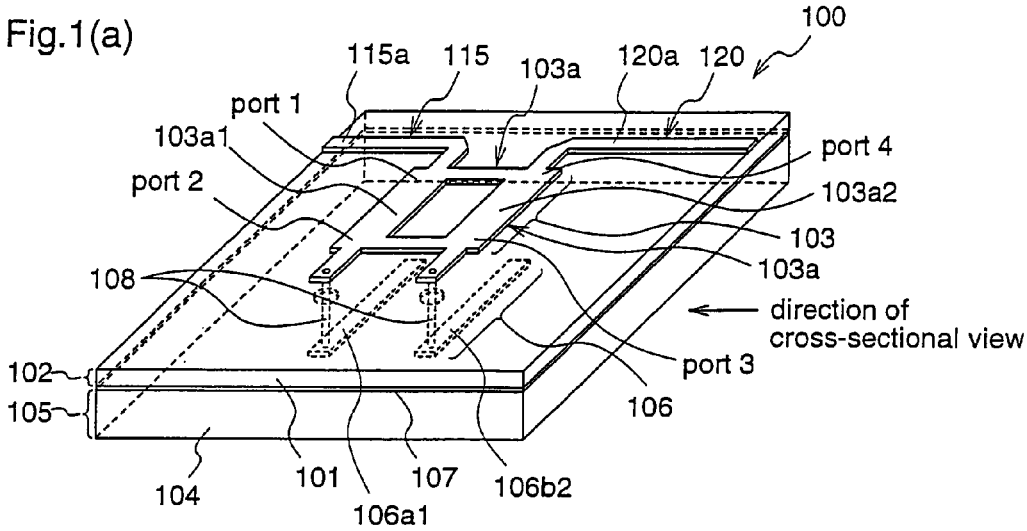
FIG. 1(*a*) is a perspective view FIG. 1(*b*) and is a cross-sectional view illustrating a construction of a phase shifter according to a first embodiment of the present invention, which is employed for a phased-array antenna.
Figure 1B:
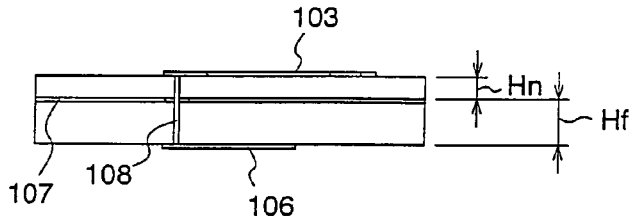

FIG. 1(*a*) is a perspective view and FIG. 1(*b*) is a cross-sectional view illustrating a construction of the phase shifter according to the first embodiment, which is employed for the phased-array antenna of the present invention.

In FIGS. 1(*a*) and 1(*b*), reference numeral 100 denotes a phase shifter. Reference numeral 101 denotes a paraelectric base material, reference numeral 102 denotes a paraelectric transmission line layer, reference numeral 103 denotes a microstrip hybrid coupler, reference numeral 104 denotes a ferroelectric base material, reference numeral 105 denotes a ferroelectric transmission line layer, reference numeral 106 denotes a microstrip stub, reference numeral 107 denotes a ground conductor, and reference numeral 108 denotes a through hole by which the microstrip hybrid coupler 103 and the microstrip stub 106 are connected through the ground conductor 107.

Initially, a feature of the phase shifter 100 according to the first embodiment, which is superior to the conventional phase shifter 700, will be described in detail.

As mentioned above, in the phase shifter 700 shown in FIG. 9(*a*), the distributed capacitance Cn per unit length of the line for the microstrip hybrid coupler 703 and the distributed capacitance Cf per unit length of the line for the microstrip stub 704 are greatly different. As a result the power from the microstrip hybrid coupler 703 does not enter the microstrip stub 704 so efficiently, whereby a sufficient phase shift amount cannot be obtained. To overcome this problem, when a magnetic material is added to the microstrip stub 704 of the phase shifter 700 to increase the distributed inductance L per unit length of the line as shown in Prior Art 1, the construction of the conventional phase shifter 700 that is formed in one piece by allocating areas on the same plane to the ferroelectric base material 702 and the paraelectric base material 701, respectively, requires much more processes, whereby the manufacturing cost is adversely increased.

Thus, in the phase shifter 100 of the first embodiment, as shown in FIG. 1(*a*), the microstrip hybrid coupler 103 is formed on the paraelectric transmission line layer 102 that employs a paraelectric material for the base material 101, the microstrip stub 106 is formed on the ferroelectric transmission line layer 105 that employs a ferroelectric material for the base material 104, these two transmission line layers 102 and 105 are laminated through the ground conductor 107, and then the microstrip hybrid coupler 103 and the microstrip stub 106 are connected via through holes 108 which pass through the ground conductor 107. Further, as shown in FIG. 1(*b*), the distance Hf between conductors that constitute the transmission line of the ferroelectric transmission line layer 105 is larger than the distance Hn between conductors that constitute the transmission line of the paraelectric transmission line layer 102. Accordingly, the line impedances Z of the microstrip hybrid coupler 103 and the microstrip stub 106 can be matched, whereby the phase shifter 100 providing an effective phase shift amount can be manufactured in simpler manufacturing processes.

A detailed explanation of the phase shifter will be given hereinafter. For example, assuming that the permittivity of the paraelectric base material 101 as the base material for the microstrip hybrid coupler 103 is $\epsilon n$, and the permittivity of the ferroelectric base material 104 as the base material for the microstrip stub 106 is $\epsilon f$, the distributed capacitance Cn per unit length of the line for the microstrip hybrid coupler 103 is given by an expression $Cn=\epsilon n \cdot W/Hn$, and the distributed capacitance Cf per unit length of the line for the microstrip stub 106 is given by an expression $Cf=\epsilon f \cdot W/Hf$. When Cn and Cf are compared with each other, the relationship $\epsilon n \ll \epsilon f$ is established as described above, but the relationship $Hn<Hf$ is established as shown in FIG. 1(*b*), so that the difference between the distributed capacitance Cn per unit length of the line for the microstrip hybrid coupler 103 and the distributed capacitance Cf per unit length of the line for the microstrip stub 106 becomes smaller. Consequently, the reduction in the matching degree between the line impedances Z of the microstrip hybrid coupler 103 and the microstrip stub 106 can be avoided, so that the power from the microstrip hybrid coupler 103 enters the microstrip stub 106 efficiently, whereby a sufficient phase shift amount can be obtained.

Hereinafter, the operating principles of the phase shifter according to the first embodiment will be described.

In the phase shifter 100, the microstrip hybrid coupler 103 using the paraelectric base material 101, the ground conductor 107, and the microstrip stub 106 using the ferroelectric base material 104 are laminated, and the microstrip hybrid coupler 103 and the microstrip stub 106 are connected via through holes 108 that pass through the ground conductor 107. This phase shifter 100 is constituted such that the phase shift amount of a high-frequency power that passes through the microstrip hybrid coupler 103 varies according to a DC control voltage that is applied to the microstrip stub 106.

In other words, the base material of the phase shifter 100 is composed of the paraelectric base material 101, the ground conductor 107, and the ferroelectric base material 104. A rectangular loop-shaped conductor layer 103*a* is disposed on the paraelectric base material 101, and this loop-shaped conductor layer 103*a* and the paraelectric base material 101 form the microstrip hybrid coupler 103.

Two linear conductor layers 106*a*1 and 106*a*2 are placed under the ferroelectric base material 104 so as to be linked to one end of the two opposed linear portions 103*a*1 and 103*a*2 of the rectangular loop-shaped conductor layer 103*a* via the through holes 108, respectively. These two linear conductor layers 106*a*1 and 106*a*2 and the ferroelectric base material 104 form the microstrip stub 106.

Conductor layers 115*a* and 120*a* are disposed on the paraelectric base material 101 so as to be located on extension lines of the two linear portions 103*a*1 and 103*a*2, and linked to the other ends of the two linear portions 103*a*1 and 103*a*2, respectively.

This conductor layer 115*a* and the paraelectric base material 101 form an input line 115, and the conductor layer 120*a* and the paraelectric base material 101 form an output line 120. Here, the one end and the other end of the linear portion 103*a*1 of the loop-shaped conductor layer 103*a* are ports 2 and 1 of the microstrip hybrid coupler 103, respectively, and the one end and the other end of the linear portion 103*a*2 of the loop-shaped conductor layer 103*a* are ports 3 and 4 of the microstrip hybrid coupler 103, respectively.

In the phase shifter 100 having the above-mentioned construction, when a DC control voltage is applied to the microstrip stub 106, the amount of phase shift of a high-frequency power that passes therethrough varies.

Hereinafter, a detailed explanation of the phase shifter 100 will be given. In the phase shifter 100 having a construction such that the same reflection element (microstrip stub 106) is connected to two adjacent ports (ports 2 and 3) of the properly-designed microstrip hybrid coupler 103 via the through holes 108, a high-frequency power that has entered from the input port (port 1) is not outputted through this input port 1, but a high-frequency power on which a reflected power from the reflection element has been reflected is outputted only through the output port (port 4). Then, a bias field is produced when the control voltage is applied to the microstrip stub 106, and an effective permittivity of the microstrip stub 106 for the high-frequency power varies when the control voltage is changed. Accordingly, an equivalent power length of the microstrip stub 106 for the high-frequency power varies, and the phase of the microstrip stub 106 varies according to changes in the equivalent power length, whereby the phase of a high-frequency power that is outputted through the output port (port 4) varies.

As described above, the phase shifter 100 according to the first embodiment is constituted by laminating planar sheet-type materials, i.e., the paraelectric base material 101, the ground conductor 107 and the ferroelectric base material 104, and forming the through holes 108 that pass through the ground conductor 107, whereby the microstrip hybrid coupler 103 that is formed on the paraelectric transmission line layer 102 and the microstrip stub 106 that is formed on the ferroelectric transmission line layer 105 are connected each other. Furthermore, in this phase shifter 100, the thickness Hf of the base material of the ferroelectric transmission line layer 105 that is provided with the microstrip stub 106 is larger than the thickness Hn of the base material of the paraelectric transmission line layer 102 that is provided with the microstrip hybrid coupler 103. Therefore, the deterioration in the line impedance matching between the microstrip hybrid coupler 103 and the microstrip stub 106 is suppressed, whereby a phase shifter that provides an effective phase shift amount can be obtained. Further, this phase shifter 100 can be manufactured in fewer manufacturing processes as compared to the method by which the base materials are disposed with allocating areas on the same plane to the respective base materials, as in the conventional phase shifter 700, and thus, the phase shifter 100 can be produced at a lower cost.

Further, when this phase shifter 100 is employed for a phased-array antenna, the phased-array antenna can be manufactured in fewer processes, thereby reducing the manufacturing cost.

Second Embodiment

A second embodiment of the present invention will be described with reference to FIGS. 2(*a*) and 2(*b*).

In this second embodiment, a phase shifter that is employed for a phased-array antenna of the present invention will be described.

Figure 2A:
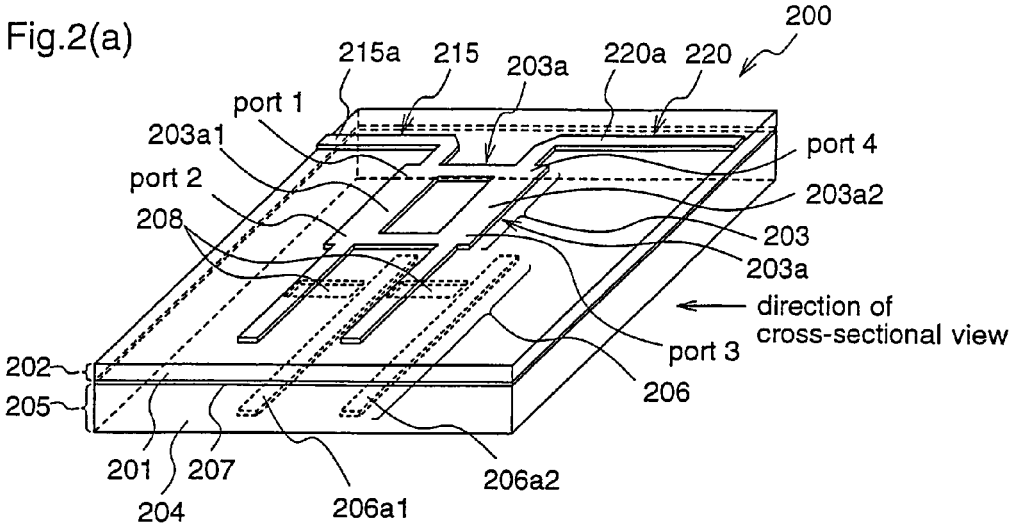
FIG. 2(*a*) is a perspective view and FIG. 2(*b* is a cross-sectional view illustrating a construction of a phase shifter according to a second embodiment of the present invention, which is employed for a phased-array antenna.
Figure 2B:
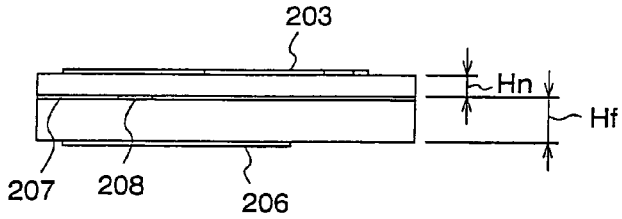

FIG. 2(*a*) is a perspective view and FIG. 2(*b*) is a cross-sectional view illustrating a construction of the phase shifter according to the second embodiment, which is employed for the phased-array antenna of the present invention.

In FIGS. 2(*a*) and 2(*b*), reference numeral 200 denotes a phase shifter. Reference numeral 201 denotes a paraelectric base material, reference numeral 202 denotes a paraelectric transmission line layer, reference numeral 203 denotes a microstrip hybrid coupler, reference numeral 204 denotes a ferroelectric base material, reference numeral 205 denotes a ferroelectric transmission line layer, reference numeral 206 denotes a microstrip stub, reference numeral 207 denotes a ground conductor, and reference numeral 208 denotes a coupling window that is formed in the ground conductor 207, for electromagnetically coupling the microstrip hybrid coupler 203 and the microstrip stub 206.

Initially, a feature of the phase shifter 200 according to the second embodiment, which is superior to the conventional phase shifter 700, will be described in detail.

Figure 9A:
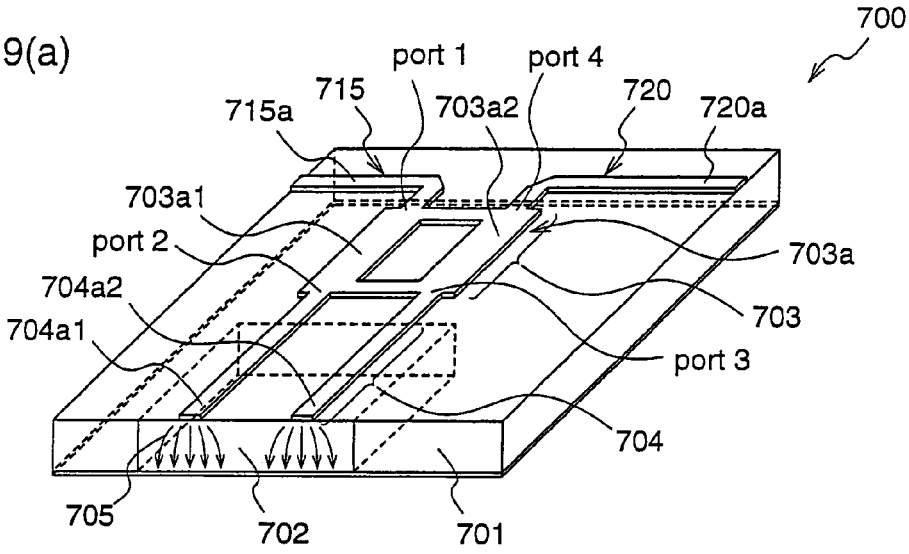
FIG. 9(*a*) is a diagram illustrating a construction of a phase shifter that is employed for a conventional phased-array antenna, and FIG. 9(*b*) is a diagram showing permittivity changing characteristics of a ferroelectric material.
Figure 9B:
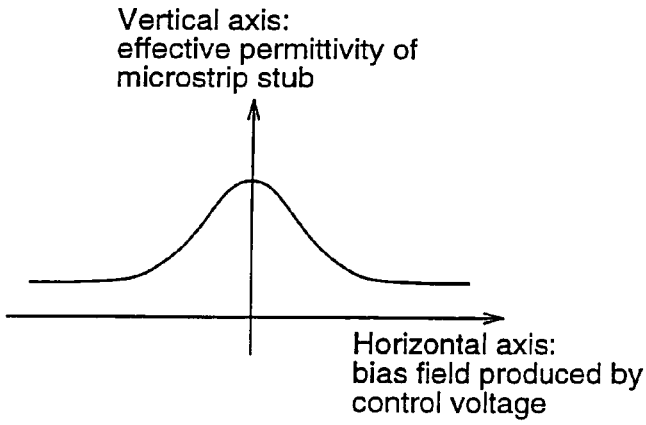
Figure 10A:
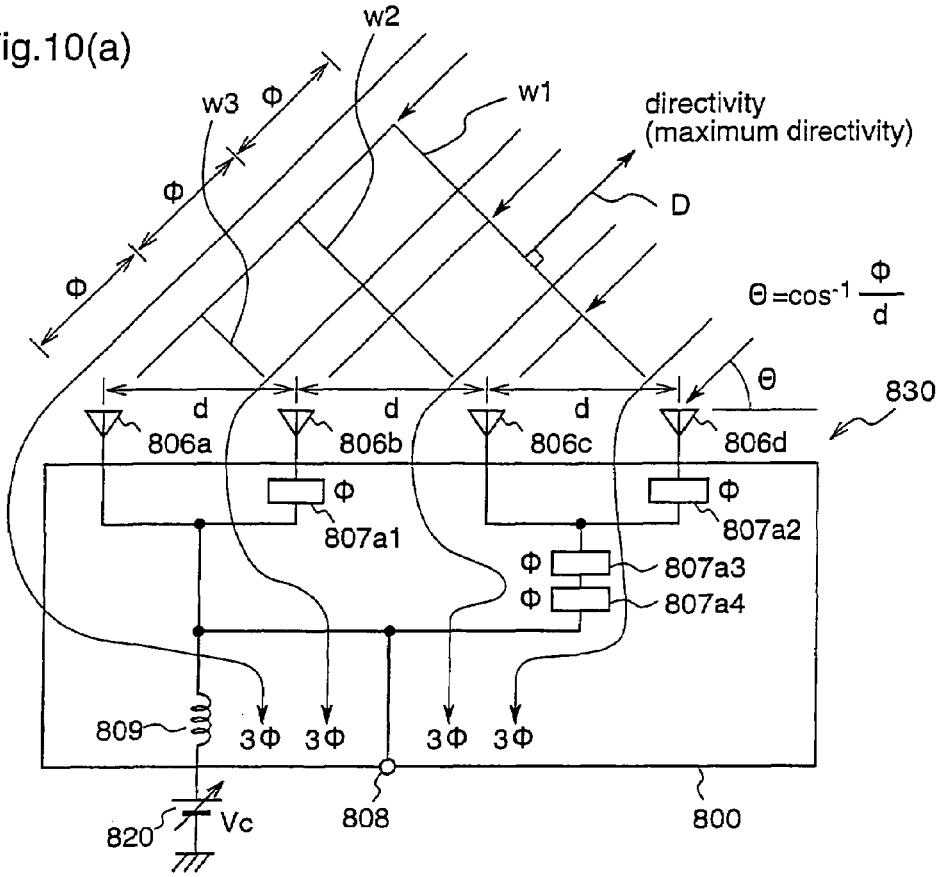
FIG. 10(*a*) is a diagram showing a construction and operating principles of the conventional phased-array antenna, and FIG. 10(*b*) is a diagram showing directivities of the conventional phased-array antenna.
Figure 10B:
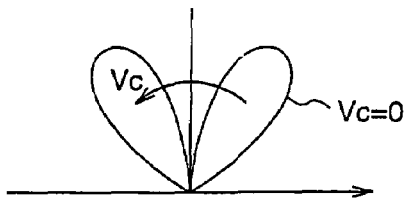

As described in the first embodiment, when a magnetic material is added to the microstrip stub 704 of the conventional phase shifter 700 shown in FIG. 9(*a*) to increase the distributed inductance L per unit length of the line as shown in Prior Art 1, so as to solve the problem that a sufficient amount of phase shift for the conventional phase shifter 700 is not obtained, the conventional phase shifter 700 that is formed in one piece by allocating areas on the same plane to the ferroelectric base material 702 and the paraelectric base material 701, respectively, needs much more processes, whereby the manufacturing cost is increased.

In the phase shifter 200 according to the second embodiment as shown in FIG. 2(*a*), the microstrip hybrid coupler 203 is formed on the paraelectric transmission line layer 202 that uses a paraelectric material for the base material 201, and the microstrip stub 206 is formed on the ferroelectric transmission line layer 205 that uses a ferroelectric material for the base material 204. In addition, these two transmission line layers 202 and 205 are then laminated through the ground conductor 207, and the microstrip hybrid coupler 203 and the microstrip stub 206 are electromagnetically connected via the coupling window 208 that is formed in the ground conductor 207. further, as shown in FIG. 2(*b*), the distance Hf between conductors that form the transmission line on the ferroelectric transmission line layer 205 is larger than the distance Hn between conductors that form the transmission line on the paraelectric transmission line layer 202. Accordingly, the line impedances Z of the microstrip hybrid coupler 203 and the microstrip stub 206 can be matched, whereby the phase shifter 200 providing an effective phase shift amount can be manufactured in simpler manufacturing processes.

Hereinafter, a detailed explanation of the phase shifter 200 will be given. For example, assuming that the permittivity of the paraelectric base material 201 as the base material of the microstrip hybrid coupler 203 is $\epsilon n$ and the permittivity of the ferroelectric base material 204 as the base material of the microstrip stub 206 is $\epsilon f$, the distributed capacitance Cn per unit length of the line for the microstrip hybrid coupler 203 is given by an expression $Cn=\epsilon n \cdot W/Hn$, and the distributed capacitance Cf per unit length of the line for the microstrip stub 206 is given by an expression $Cf=\epsilon f \cdot W/Hf$. When Cn and Cf are compared with each other, the relationship $\epsilon n << \epsilon f$ is established, but in this second embodiment, the relationship of $Hn<Hf$ is established as shown in FIG. 2(*b*). Accordingly, the difference between the distributed capacitance Cn per unit length of the line for the microstrip hybrid coupler 203 and the distributed capacitance Cf per unit length of the line for the microstrip stub 206 becomes smaller. Consequently, the deterioration of the matching between the line impedances Z of the microstrip hybrid coupler 203 and the microstrip stub 206 can be avoided, whereby the power from the microstrip hybrid coupler 203 enters the microstrip stub 206 efficiently, and a sufficient phase shift amount can be obtained.

Hereinafter, the operating principles of the phase shifter 200 according to the second embodiment will be described.

In this phase shifter 200, the microstrip hybrid coupler 203 using the paraelectric base material 201, the ground conductor 207, and the microstrip stub 206 using the ferroelectric base material 204 are laminated, and the microstrip hybrid coupler 203 and the microstrip stub 206 are electromagnetically connected via the coupling window 208 that is formed in the ground conductor 207. This phase shifter 200 is constituted so that the amount of phase shift of the high-frequency power that passes through the microstrip hybrid coupler 203 varies according to a DC control voltage that is applied to the microstrip stub 206.

In other words, the base material of the phase shifter 200 is composed of the paraelectric base material 201, the ground conductor 207, and the ferroelectric base material 204. A rectangular loop-shaped conductor layer 203*a* is disposed on the paraelectric base material 201, and this loop-shaped conductor layer 203*a* and the paraelectric base material 201 form the microstrip hybrid coupler 203.

Two linear conductor layers 206*a*1 and 206*a*2 are disposed under the ferroelectric base material 204 so as to be electromagnetically connected to one end of the two opposed linear portions 203*a*1 and 203*a*2 of the rectangular loop-shaped conductor layer 203*a*, respectively, via the coupling window 208. These two linear conductor layers 206*a*1 and 206*a*2 and the ferroelectric base material 204 form the microstrip stub 206.

Further, conductor layers 215*a* and 220*a* are disposed on the paraelectric base material 201 so as to be located on extension lines of the two linear portions 203*a*1 and 203*a*2 and linked to the other ends of the two linear portions 203*a*1 and 203*a*2, respectively.

This conductor layer 215*a* and the paraelectric base material 201 form an input line 215, and the conductor layer 220*a* and the paraelectric base material 201 form an output line 220. Here, the one end and the other end of the linear portion 203*a*1 of the loop-shaped conductor layer 203*a* are ports 2 and 1 of the microstrip hybrid coupler 203, respectively, and the one end and the other end of the linear portion 203*a*2 of the loop-shaped conductor layer 203*a* are ports 3 and 4 of the microstrip hybrid coupler 203, respectively.

In the phase shifter 200 having the above-mentioned construction, when a DC control voltage is applied to the microstrip stub 206, the amount of phase shift of the high-frequency power that passes therethrough varies.

Hereinafter, a detailed explanation of the phase shifter 200 will be given. In the phase shifter 200 in which the same reflection element (microstrip stub 206) is electromagnetically connected to two adjacent ports (ports 2 and 3) of the properly-designed microstrip hybrid coupler 203 via the coupling window 208, a high-frequency power that has entered from the input port (port 1) is not outputted from this input port 1, and a high-frequency power upon which a reflected power from the reflection element has been reflected is outputted only through the output port (port 4). Then, a bias field is produced when a control voltage is applied to the microstrip stub 206, and the effective permittivity of the microstrip stub 206 for the high-frequency power varies when this control voltage is changed. Accordingly, the equivalent electrical length of the microstrip stub 206 for the high-frequency power varies, whereby the phase of the high-frequency power that is outputted from the output port (port 4) varies.

As described above, according to the second embodiment, the phase shifter 200 is constituted by laminating planar sheet-type materials, i.e., the paraelectric base material 201, the ground conductor 207 comprising the coupling window 208, and the ferroelectric base material 204, in which the thickness Hf of the base material for the ferroelectric transmission line layer 205 that is provided with the microstrip stub 206 is larger than the thickness Hn of the base material for the paraelectric transmission line layer 202 that is provided with the microstrip hybrid coupler 203. Therefore, the deterioration of the line impedance matching between the microstrip hybrid coupler 203 and the microstrip stub 206 can be avoided, whereby a phase shifter providing an effective phase shift amount can be obtained. Further, this phase shifter 200 can be manufactured in fewer manufacturing processes as compared to the method by which the base materials are disposed such that areas on one plane are allocated to the respective base materials, as in the conventional phase shifter 700, whereby the phase shifter can be produced with a lower cost.

Further, when the phase shifter 200 is employed for a phased-array antenna, the phased-array antenna can be manufactured in fewer processes, thereby reducing the manufacturing cost.

Third Embodiment

A third embodiment of the present invention will be described with reference to FIGS. 3(*a*) and 3(*b*).

Figure 3A:
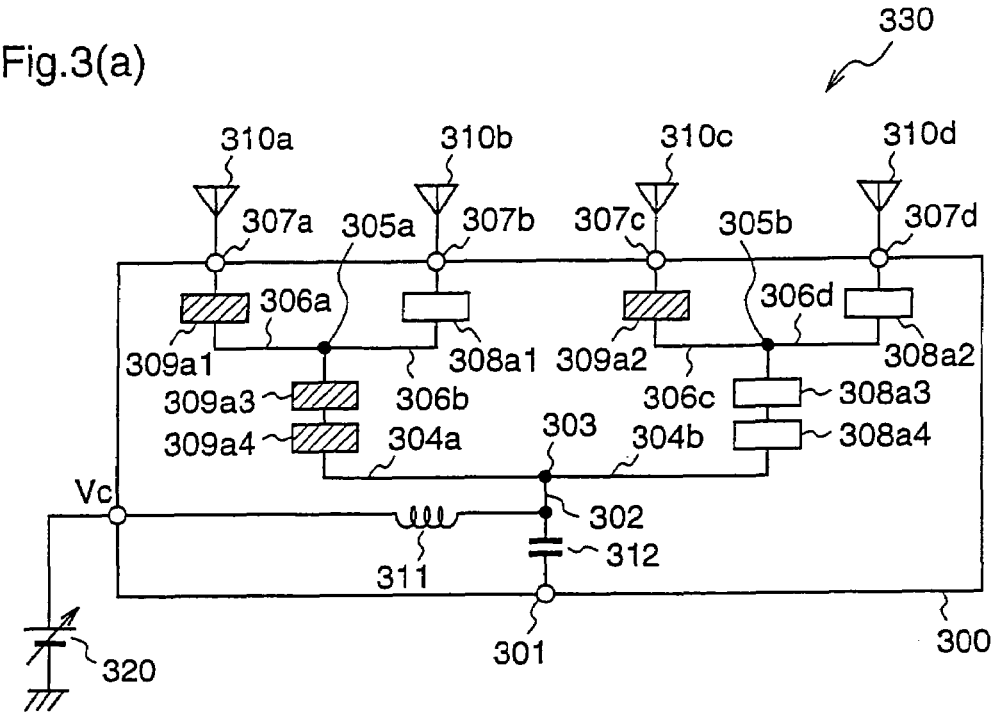
FIG. 3(*a*) is a diagram illustrating a construction of a phased-array antenna according to a third embodiment of the present invention, and FIG. 3(*b*) is a diagram showing directivities of this phased-array antenna.
Figure 3B:
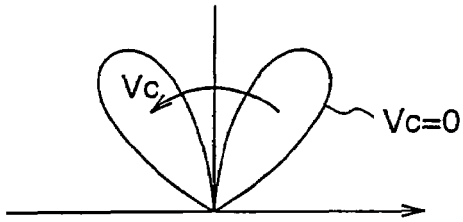

FIG. 3(*a*) is a diagram illustrating a construction of a phased-array antenna according to the third embodiment, and FIG. 3(*b*) is a diagram showing directivities of the phased-array antenna according to the third embodiment in a case where a beam tilt voltage is applied and a case where a beam tilt voltage is not applied.

In FIG. 3(*a*), a phased-array antenna 330 according to the third embodiment comprises an antenna control unit 300, a beam tilt voltage 320 for performing control of the directivity (beam tilt) as shown in FIG. 3(*b*), and four antenna elements 310*a*-310*d*. The antenna control unit 300 comprises an input terminal (feeding terminal) 301, four antenna terminals 307*a*-307*d*, four phase shifters 308*a*1-308*a*4, four loss elements 309*a*1-309*a*4, a high frequency blocking element 311, a DC blocking element 312, a transmission line (feeding line) 302 from the input terminal 301, two transmission lines 304*a* and 304*b* that branch off at a first branch 303, and four transmission lines 306*a*-306*d* that branch off from the transmission lines 304*a* and 304*b* at second branches 305*a* and 305*b*.

Hereinafter, the construction of the antenna control unit 300 that constitutes the phased-array antenna 330 according to the third embodiment will be described in more detail.

The antenna control unit 300 according to the third embodiment includes one input terminal 301, the transmission line 302 from the input terminal 301 then branches off into two transmission lines 304*a* and 304*b* at the first branch 303, and further, the two transmission lines 304*a* and 304*b* that branch off at the first branch 303 further branch off into two transmission lines at the second branches 305*a* and 305*b*, whereby four branched transmission lines 306*a*-306*d* are obtained.

Further, the input terminal 301 is connected to the first branch 303 through the blocking element 312, and the beam tilt voltage 320 is connected to the first branch 303 through the high frequency blocking element 311.

The four transmission lines 306*a*-306*d* are provided with four antenna terminals 307*a*-307*d* for connection with the four antenna elements 310*a*-310*d*.

When the four antenna terminals 307*a*-307*d* are arranged in a row, which are referred to as first, second, third, and fourth antenna terminals, respectively, and when it is assumed that n is an integer that satisfies 0<n<4, the phase shifters 308*a*1-308*a*4 are arranged so that the number of phase shifters 308*a* which are located between the (n+1)-th antenna terminal 307 and the input terminal 301 is one larger than the number of phase shifters 308*a* which are located between the n-th antenna terminal 307 and the input terminal 301. Here, the respective phase shifters 308*a*1-308*a*4 have the same characteristics.

Further, in the antenna control unit 300 according to the third embodiment, the loss elements 309*a*1-309*a*4 each having a transmission loss that is equal to a transmission loss amount corresponding to one phase shifter 308*a* are placed so that the number of loss elements 309*a* which are located between the n-th antenna terminal 307 and the input terminal 301 is one larger than the number of loss elements 309*a* which are located between the (n+1)-th antenna terminal 307 and the input terminal 301. Therefore, the transmission loss amounts from all the antenna terminals 307*a*-307*d* to the input terminal 301 are of the same value.

In common phased-array antennas, when the transmission loss amounts from the respective antenna elements 310*a*-310*d* to the input terminal 301 as a power composition point are different from each other, the power compositing effect is reduced, whereby the shape of the beam as shown in FIG. 3(*b*) is deformed and it becomes difficult to obtain a pointed beam (large directivity gain), and the beam tilt amount is reduced. As a result, the control of the antenna's directivity is deteriorated.

However, in the antenna control unit 300 according to the third embodiment, the loss elements 309*a* are placed so that the amount of transmission loss which occurs from then-th antenna terminal 307 (n is an integer that satisfies 0<n<4) to the input terminal 301 is larger than the transmission loss amount from the (n+1)-th antenna terminal 307 to the input terminal 301, by an amount as much as the transmission loss corresponding to one phase shifter 308*a*. Therefore, the transmission loss amounts from all the antenna elements 310*a*-310*d* to the input terminal 301 are of the same value, whereby a phased-array antenna that has a pointed beam and a satisfactory beam tilt amount can be realized.

As described above, according to the third embodiment, when n is an integer that satisfies 0<n<4, the phase shifters 308*a* are placed such that the number of phase shifters 308*a* which are located between the (n+1)-th antenna terminal 307 and the input terminal 301 is one larger than the number of phase shifters 308*a* which are located between the n-th antenna terminal 307 and the input terminal 301. Further, the loss elements 309*a* are placed such that the transmission loss amount from the n-th antenna terminal 307 to the input terminal 301 is larger than the transmission loss amount from the (n+1)-th antenna terminal 307 to the input terminal 301, by an amount as much as the transmission loss corresponding to one phase shifter 308*a*. Therefore, even when any passage loss is generated in the phase shifters 308*a*1-308*a*4, the amounts of distributed power for the respective antenna elements 310*a*-310*d* are not different from each other. Consequently, the antenna control unit 300 by which the beam shape is not deformed or the changes in the beam direction are not reduced can be obtained. Further, when this antenna control unit 300 is employed for a phased-array antenna, the transmission loss amounts from all of the antenna elements 310*a*-310*d* to the input terminal 301 can be made equal, whereby a phased-array antenna that has a pointed beam and a satisfactory beam tilt amount can be realized.

Further, when the phase shifter as described in the first or second embodiment is employed for the phased-array antenna according to the third embodiment, the manufacturing cost of the phased-array antenna can be further reduced.

Fourth Embodiment

A fourth embodiment will be described with reference to FIGS. 4(*a*) and 4(*b*).

In this fourth embodiment, an antenna control unit in a phased-array antenna, which has a different construction from that of the third embodiment, will be described in detail.

Figure 4A:
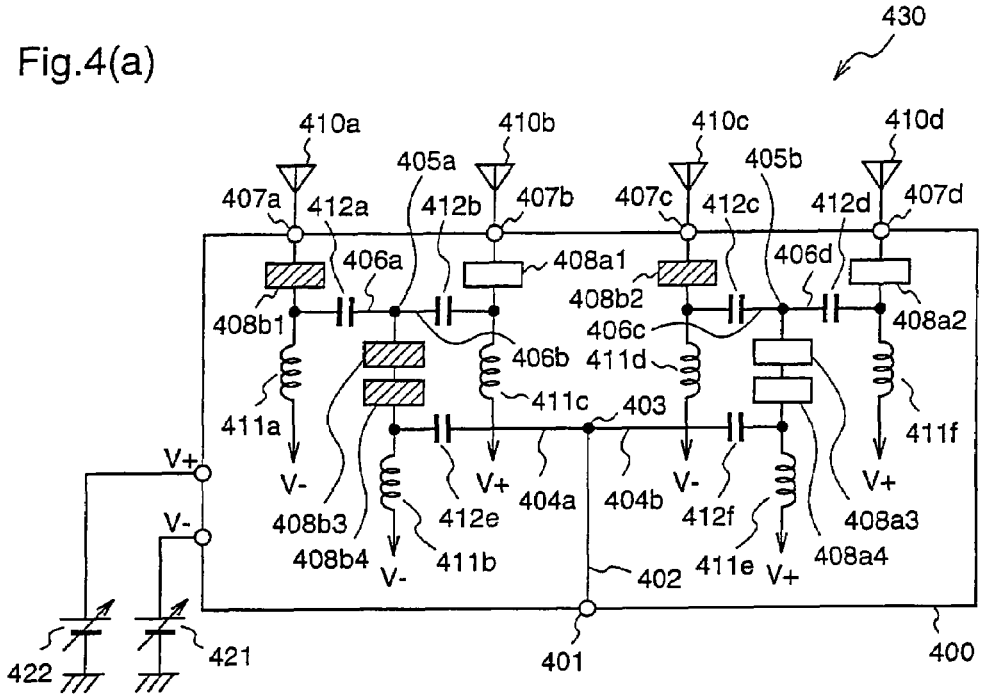
FIG. 4(*a*) is a diagram illustrating a construction of a phased-array antenna according to a fourth embodiment of the present invention, and FIG. 4(*b*) is a diagram showing directivities of this phased-array antenna.
Figure 4B:
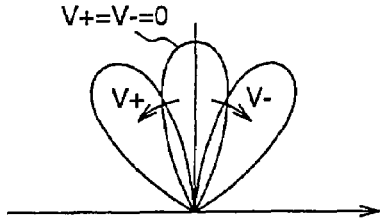

FIG. 4(*a*) is a diagram illustrating a construction of a phased-array antenna according to the fourth embodiment, and FIG. 4(*b*) is a diagram showing directivities of the phased-array antenna according to the fourth embodiment in a case where a beam tilt voltage is applied and a case where the beam tilt voltage is not applied.

In FIG. 4(*a*), a phased-array antenna 430 according to the fourth embodiment comprises an antenna control unit 400, negative and positive beam tilt voltages 421 and 422 that perform control on negative and positive directivities (beam tilt), respectively, as shown in FIG. 4(*b*), and four antenna elements 410*a*-410*d*. The antenna control unit 400 comprises an input terminal 401, four antenna terminals 407*a*-407*d*, four positive beam tilting phase shifters 408*a*1-408*a*4, four negative beam tilting phase shifters 408*b*1-408*b*4, high frequency blocking elements 411*a*-411*f*, DC blocking elements 412*a*-412*f*, a transmission line 402 from the input terminal 401, two transmission lines 404*a* and 404*b* that branch off at a first branch 403, and four transmission lines 406*a*-406*d* that branch off from the transmission lines 404*a* and 404*b* at second branches 405*a* and 405*b*.

Hereinafter, the antenna control unit 400 that constitutes the phased-array antenna 430 according to the fourth embodiment will be described in more detail.

The antenna control unit 400 of the fourth embodiment includes one input terminal 401, and the transmission line 402 from the input terminal 401 then branches off into the two transmission lines 404*a* and 404*b* at the first branch 403. Further, the two transmission lines 404*a* and 404*b* that branch off at the first branch 403 branch off into two transmission lines at the second branches 405*a* and 405*b*, respectively, thereby resulting in four transmission lines 406*a*-406*d*.

Each of the two transmission lines 404*a* and 404*b* that branch off at the first branch 403 is provided with one DC blocking element 412, and further, each of the four transmission lines 406*a*-406*d* that branch off at the second branches 405*a* and 405*b*, respectively, is provided with one DC blocking element 412. A high frequency block element 411 is placed on one end of the respective negative beam tilting phase shifters 408*b*1, 408*b*4, and, 408*b*2, and on one end of the respective positive beam tilting phase shifters 408*a*1, 408*a*4, and 408*a*2.

The four transmission lines 406*a*-406*d* are provided with four antenna terminals 407*a*-407*d*, respectively, so as to be connected to four antenna elements 410*a*-410*d*.

These four antenna terminals 407*a*-407*d*, which are referred to as first, second, third, and fourth antenna terminals, respectively, are arranged in a row, and when assuming that n is an integer that satisfies 0<n<4, the positive beam tilting phase shifters 408*a*1-408*a*4 are placed so that the number of phase shifters which are located from the (n+1)-th antenna terminal 407 to the input terminal 401 is one larger than the number of phase shifters which are located from the n-th antenna terminal 407 to the input terminal 401.

Further, the negative beam tilting phase shifters 408*b*1-408*b*4 are placed so that the number of phase shifters which are located between the n-th antenna terminal 407 and the input terminal 401 is one larger than the number of phase shifters which are located between the (n+1)-th antenna terminal 407 and the input terminal 401.

Here, the positive beam tilting phase shifters 408*a*1-408*a*4 and negative beam tilting phase shifters 408*b*1-408*b*4 all have the same characteristics (same transmission loss amount).

Therefore, in the antenna control unit 400 having the above-mentioned construction, the transmission loss amounts from all the antenna terminals 407*a*-407*d* to the input terminal 401 are the same.

In common phased-array antennas, when the transmission loss amounts from the respective antenna elements 410*a*-410*d* to the input terminal 401 as the electric power composition point are different from each other, the electric power composition effect is reduced, whereby the shape of beam as shown in FIG. 4(*b*) is deformed, and thus it is difficult to obtain a pointed beam (large directivity gain), and the beam tilt amount is reduced. As a result, the control on the antenna's directivity is deteriorated.

Further, in a phased-array antenna that uses the ferroelectric material for the phase shifter 408, when the rate of change in the permittivity of the ferroelectric material is small, a phase shift amount that can be realized by one phase shifter 408 is small, so that it is quite difficult to obtain a phased-array antenna having a large amount of beam tilt.

However, in this antenna control unit 400 according to the fourth embodiment, the transmission loss amounts from all the antenna elements 410*a*-410*d* to the input terminal 401 are the same, and further, the positive beam tilting phase shifters 408*a* and the negative beam tilting phase shifters 408*b* are provided. Therefore, each of the phase shifters 408 takes charge of only a smaller phase shift amount, whereby a phased-array antenna having a more pointed beam and a more satisfactory beam tilt amount can be realized.

As described above, according to the fourth embodiment, when n is an integer that satisfies 0<n<4, the positive beam tilting phase shifters 408*a*1-408*a*4 are placed so that the number of positive beam tilting phase shifters 408*a* which are located between the (n+1)-th antenna terminal 407 and the input terminal 401 is one larger than the number of positive beam tilting phase shifters 408*a* which are located between the n-th antenna terminal 407 and the input terminal 401. Further, the negative beam tilting phase shifters 408*b*1-408*b*4 are placed so that the number of negative beam tilting phase shifters 408*b* which are located between the n-th antenna terminal 407 and the input terminal 401 is one larger than the number of negative beam tilting phase shifters 408*b* which are located between the (n+1)-th antenna terminal 407 and the input terminal 401. Therefore, each of the phase shifters 408 takes charge of only a smaller phase shift amount, and consequently, an antenna control unit 400 which does not reduce the beam tilt amount even when the permittivity change rate for the ferroelectric material of each phase shifter 408 is low can be obtained. Further, when the antenna control unit 400 is employed, the transmission loss amounts from all the antenna elements 410*a*-410*d* to the input terminal 401 can be equalized, whereby a phased-array antenna that has a more pointed beam and a more satisfactory beam tilt amount can be realized.

Further, when the phase shifter as described in the first or second embodiment is employed for the phased-array antenna according to the fourth embodiment, the manufacturing cost of the phased-array antenna can be further reduced.

Fifth Embodiment

A fifth embodiment of the present invention will be described with reference to FIG. 5.

In this fifth embodiment, a description will be given of a phased-array antenna comprising a two-dimensional antenna control unit that is obtained by combining a plurality of the antenna control units that have been described in the third embodiment, and can control the directivity in the X-axis direction and the Y-axis direction.

Figure 5:
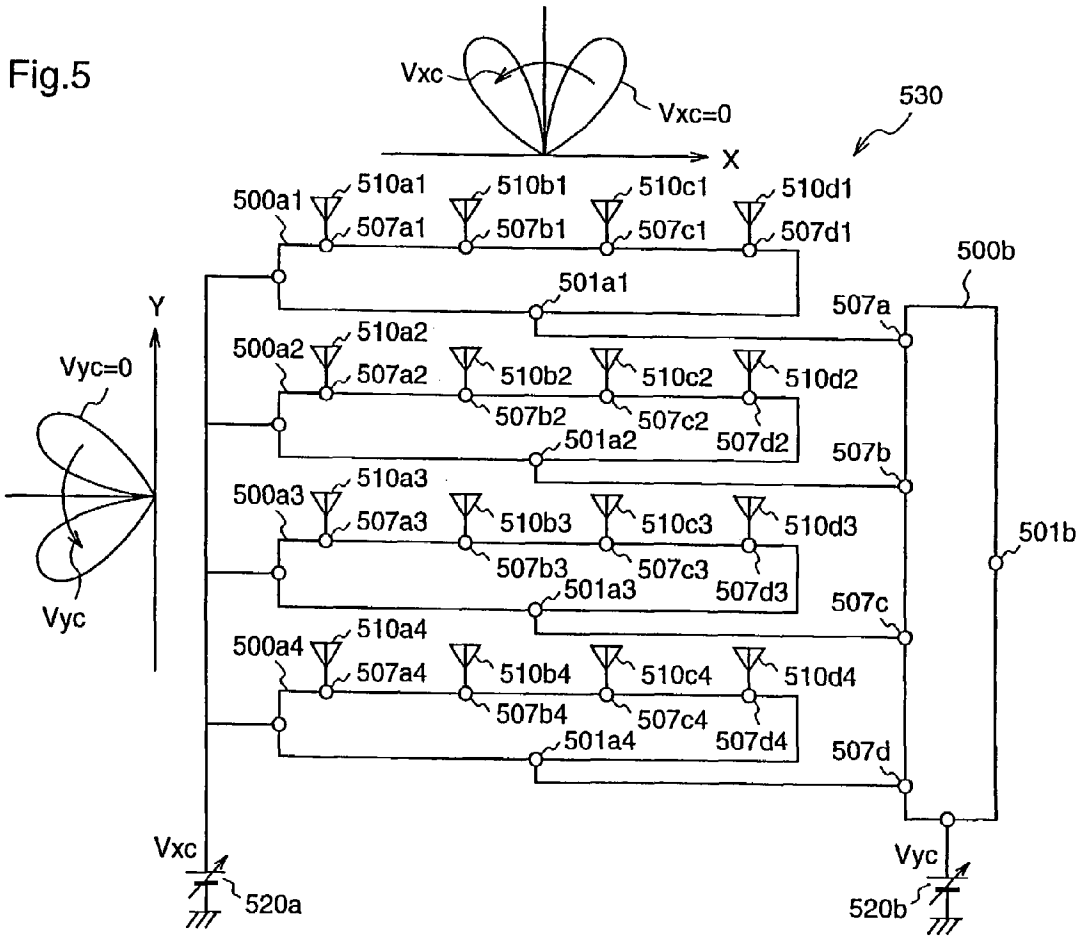
FIG. 5 is a diagram illustrating a construction of a phased-array antenna according to a fifth embodiment of the present invention.

FIG. 5 is a diagram illustrating a construction of a phased-array antenna according to the fifth embodiment.

In FIG. 5, a phased-array antenna 530 according to the fifth embodiment comprises antenna elements 510*a*(1-4)-510*d*(1-4), X-axial antenna control units 500*a*1-500*a*4 that perform control of the X-axial directivity (beam tilt), a Y-axial antenna control unit 500*b* that performs control of the Y-axial directivity, an X-axial beam tilt voltage 520*a*, and a Y-axial beam tilt voltage 520*b*. Each of the X-axial antenna control units 500*a* includes antenna terminals 507*a*-507*d*, and an input terminal 501*a*. The Y-axial antenna control unit 500*b* includes antenna terminals 507*a*-507*d*, and an input terminal 501*b*. Here, it is assumed that each of the X-axial antenna control units 500*a*1-500*a*4 and the Y-axial antenna control unit 500*b* has the same construction as that of the antenna control unit 300 as described above in detail in the third embodiment.

Hereinafter, the phased-array antenna 530 according to this embodiment will be specifically described.

The input terminals 501*a*1-501*a*4 of the X-axial antenna control units 500*a*1-500*a*4 are connected to the antenna terminals 507*a*-507*d* of the Y-axial antenna control unit 500*b*, respectively. Although not shown here, four phase shifters 308*a* and four loss elements 309*a* each having the same transmission loss amount are disposed in each of the X-axial antenna control units 500*a*1-500*a*4 and the Y-axial antenna control unit 500*b* as shown in FIG. 3, as described in the third embodiment.

Therefore, according to the phased-array antenna 530 of the fifth embodiment, the transmission loss amounts from all the antenna terminals 507*a*-507*d* to the input terminal 501*a* in the X-axial antenna control units 500*a*1-500*a*4 are of the same value, and further, the transmission loss amounts from all the antenna terminals 507*a*-507*d* to the input terminal 501*b* in the Y-axial antenna control unit 500*b* are of the same value. Accordingly, a phased-array antenna that has a pointed beam (large directivity gain) and a satisfactory beam tilt amount, and that can control the X-axial directivity and the Y-axial directivity can be realized.

As described above, the phased-array antenna of the fifth embodiment employs an antenna control unit which includes the X-axial antenna control units 500*a*1-500*a*4 that control the X-axial directivity and the Y-axial antenna control unit 500*b* that controls the Y-axial directivity. Further, as the X-axial and Y-axial antenna control units 500, an antenna control unit as described in the third embodiment, which is provided with the phase shifters 308*a* and the loss elements 309*a* which number as many as the phase shifters 308*a*, is employed, where each loss element has the same transmission loss amount as the phase shifter 308*a*, whereby the distributed power to the respective antenna elements 510 is equalized also when any passage loss occurs in the phase shifter 308, thereby to prevent the deformation of the beam shape or the reduction in the beam tilt changes. Therefore, a phased-array antenna that has a pointed beam (large directivity gain) and a satisfactory beam tilt amount, and that can control the X-axial and Y-axial directivities can be realized.

Sixth Embodiment

A sixth embodiment of the present invention will be described with reference to FIG. 6.

In this sixth embodiment, a phased-array antenna having a two-dimensional antenna control unit which is obtained by combining a plurality of the antenna control units as described in the fourth embodiment and can control X-axial and Y-axial directivities will be described.

Figure 6:
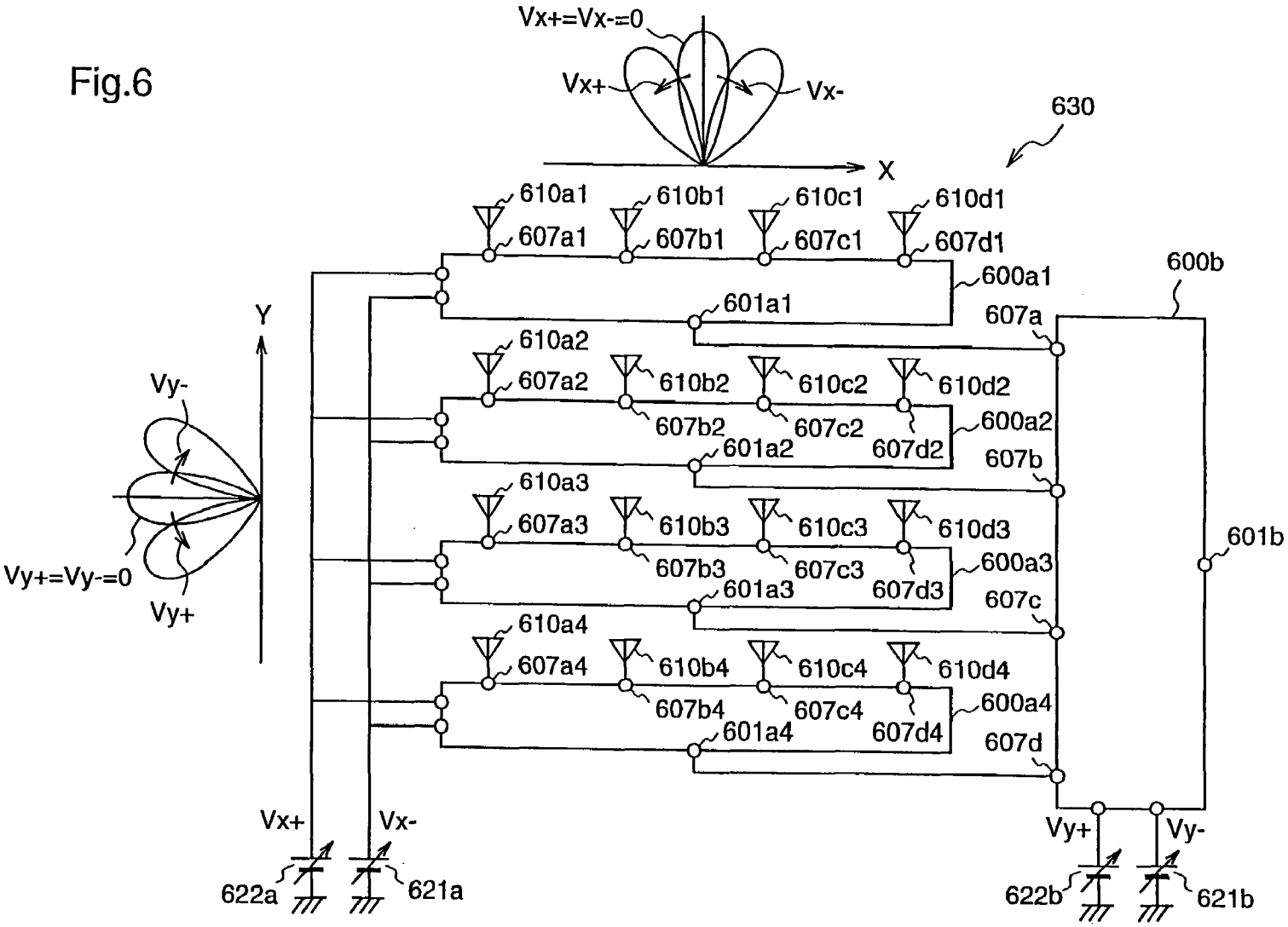
FIG. 6 is a diagram illustrating a construction of a phased-array antenna according to a sixth embodiment of the present invention.

FIG. 6 is a diagram illustrating a construction of a phased-array antenna according to the sixth embodiment.

In FIG. 6, a phased-array antenna 630 of the sixth embodiment includes antenna elements 610*a*(1-4)-610*d*(1-4), X-axial antenna control units 600*a*1-600*a*4 that perform control of the X-axial directivity (beam tilt), a Y-axial antenna control unit 600*b* that performs control of the Y-axial directivity, an X-axial negative beam tilt voltage 621*a*, an X-axial positive beam tilt voltage 622*a*, a Y-axial negative beam tilt voltage 621*b*, and a Y-axial positive beam tilt voltage 622*b*. Further, each of the X-axial antenna control units 600*a* includes antenna terminals 607*a*-607*d*, and an input terminal 601*a*. The Y-axial antenna control unit 600*b* includes antenna terminals 607*a*-607*d*, and the input terminal 601*b*. It is assumed here that each of the X-axial antenna control units 600*a*1-600*a*4 and the Y-axial antenna control unit 600*b* has the same construction as that of the antenna control unit 400 that has been specifically described in the fourth embodiment.

Hereinafter, the phased-array antenna 630 according to the sixth embodiment will be described in more detail.

The input terminals 601*a*1-601*a*4 of the X-axial antenna control units 600*a*1-600*a*4 are connected to the antenna terminals 607*a*-607*d* of the Y-axial antenna control unit 600*b*, respectively. Although not shown here, four positive beam tilting phase shifters 408*a* and four negative beam tilting phase shifters 408*b* are included in each of the X-axial antenna control units 600*a*1-600*a*4 and the Y-axial antenna control unit 600*b*, as shown in FIG. 4, as described in the fourth embodiment.

Therefore, according to the phased-array antenna 630 of the sixth embodiment, in each of the X-axial antenna control units 600*a*1-600*a*4 and the Y-axial antenna control unit 600*b*, the transmission loss amounts from all the antenna terminals 607*a*-607*d* to the input terminal 601*a* are of the same value, and each phase shifter takes charge of only a smaller phase shift amount, whereby a phased-array antenna which has a more pointed beam and a more satisfactory beam tilt amount, and which can control the X-axial and Y-axial directivities can be realized.

As described above, according to the sixth embodiment, the phased-array antenna includes the X-axial antenna control units 600*a*1-600*a*4 that control the X-axial directivity, and the Y-axial antenna control unit 600*b* that controls the Y-axial directivity. Further, as the X-axial and Y-axial antenna control units 600, an antenna control unit is employed in which equal numbers of positive beam tilting phase shifters 408*a* and negative beam tilting phase shifters 408*b* each having the same transmission loss amount are disposed as described in the fourth embodiment. Thus, each of the phase shifters 408 takes charge of only a smaller phase shift amount even when the permittivity change rate of the ferroelectric material for each phase shifter 408 is low, thereby avoiding the reduction in the beam tilt amount. Further, the distributed power to the respective antenna elements 610 are equalized even when the passage loss arises in each phase shifter, whereby the deformation of the beam shape or the reduction of changes in the beam direction can be prevented. Therefore, a phased-array antenna which has a more pointed beam and a more satisfactory beam tilt amount, and which can control the X-axial and Y-axial directivities can be realized.

Further, in each of the antenna control units 600 that constitute the phased-array antenna of the sixth embodiment, when the X-axial positive beam tilting phase shifters, the X-axial negative beam tilting phase shifters, the Y-axial positive beam tilting phase shifters, and the Y-axial negative beam tilting phase shifters are disposed on different layers, a more high-density and compact antenna control unit can be realized in addition to the above-mentioned effects.

In the description of any of the above embodiments, the transmission lines that constitute the microstrip hybrid coupler and the microstrip stub of the phase shifter are of the microstrip line type. However, when any type of a dielectric waveguide such as a strip line type, a H-line dielectric waveguide, or a NRD dielectric waveguide is employed, the same effects as described above are also achieved.

Further, while four antenna elements are employed in any of the above-mentioned embodiments, another number of antenna elements may be employed. For example, when a feeding line (transmission line) branches off into m lines through k branch stages from an input terminal to which a high-frequency power is applied (m=2^k (k-th power of 2), (k is an integer)), only m pieces of antenna elements are required, and the number $M_k$ of phase shifters that are then required can be given by the following expression:

$$M_k = M_{(k-1)} \times 2 + 2^{(k-1)} \text{ (when } k \geqq 1,\ M_1 = 1)$$

Figure 8A:
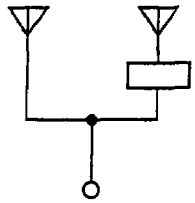
FIG. 8(*a*) is a diagram showing placements of phase shifters when k=1 and m=2, FIG. 8(*b*) is a diagram showing placements of phase shifters when k=2 and m=4, and FIG. 8(*c*) is a diagram showing placements of phase shifters when k=3 and m=8.
Figure 8B:
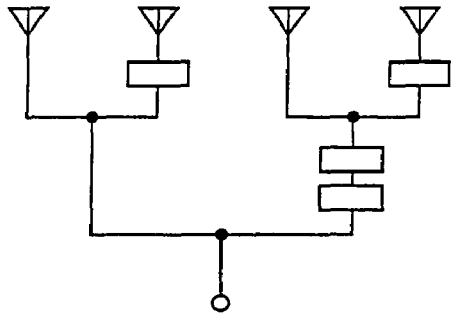
Figure 8C:
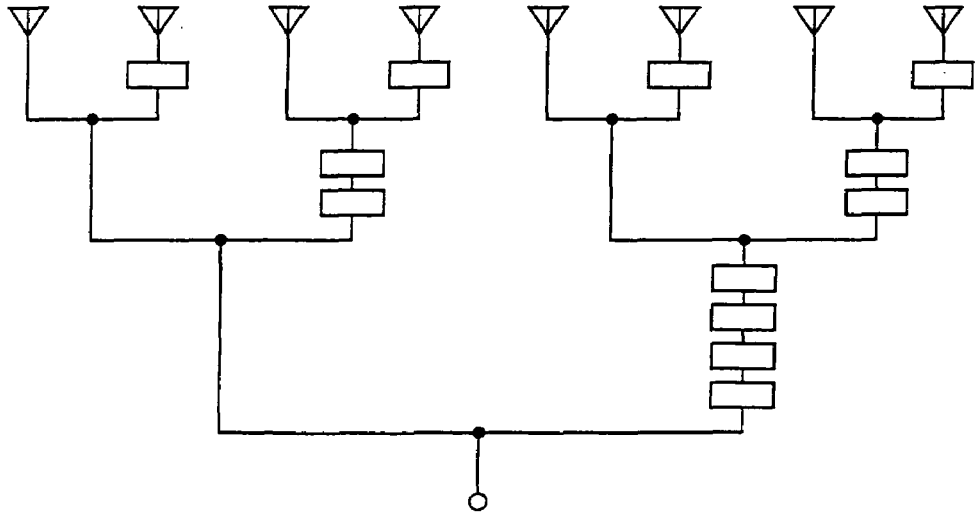

Hereinafter, a detailed explanation will be given with reference to FIGS. 7 and 8. FIG. 7 is a diagram showing the relationship of the number of branch stages (k), the number of antenna elements (m), and the number of phase shifters ($M_k$) in the antenna control unit or phased-array antenna according to the sixth embodiment. FIG. 8(*a*) is a diagram showing an arrangement of phase shifters in a case where k=1 and m=2 in FIG. 7, FIG. 8(*b*) is a diagram showing an arrangement of phase shifters in a case where k=2 and m=4, and FIG. 8(*c*) is a diagram showing an arrangement of phase shifters in a case where k=3 and m=8.

For example, when the number of branch stages is k=3, the number m of antenna elements is m=2^3=8 as shown in FIG. 7, and the number $M_3$ of phase shifters is $M_3=M_2\times2+2\hat{}2=12$. The phase shifters in this case are arranged as shown in FIG. 8(*c*) such that the number of phase shifters which are located between the (n+1)-th antenna terminal (0<n<8) and the input terminal is one larger than the number of phase shifters which are located between the n-th antenna terminal and the input terminal. For the sake of simplifying the explanation, only $M_k$ phase shifters are shown in FIG. 8, but in the antenna control unit 300 as described in the third embodiment and the phased-array antenna 330 that employs this antenna control unit 300, $M_k$ loss elements which number as many as the phase shifters are further disposed as shown in FIG. 3. In the case of the antenna control unit 400 as described in the fourth embodiment and the phased-array antenna 430 that employs this antenna control unit 400, when the $M_k$ phase shifters shown in this figure are positive beam tilting phase shifters, $M_k$ negative beam tilting phase shifters are further disposed as shown in FIG. 4.

INDUSTRIAL AVAILABILITY

The antenna control unit and the phased-array antenna according to the present invention are quite useful in realizing a low-cost antenna control unit and phased-array antenna that has a pointed beam (large directivity gain) and a satisfactory beam tilt amount, and that can be manufactured in fewer manufacturing processes. The antenna control unit and the phased-array antenna are particularly suitable for use in mobile unit identifying radio, or automobile collision avoidance radar.

The invention claimed is:

1. An antenna control unit including plural antenna terminals to which antenna elements are connected, a feeding terminal to which a high-frequency power is applied, and phase shifters which are connected to the respective antenna terminals by feeding lines that branch off from said feeding terminal and electrically change a phase of a high-frequency signal that passes through the respective antenna terminals and the feeding terminal, said phase shifters being placed at some positions on the feeding lines, wherein:

each of said phase shifters includes a hybrid coupler on a paraelectric transmission line layer that employs a paraelectric material as a base material, and a stub on a ferroelectric transmission line layer that employs a ferroelectric material as a base material;

the paraelectric transmission line layer and the ferroelectric transmission line layer are laminated through a ground conductor, and said hybrid coupler and said stub are connected via a through hole that passes through the ground conductor; and a distance between conductors that form a transmission line on the ferroelectric transmission line layer is larger than a distance between conductors that form a transmission line on the paraelectric transmission line layer.

2. An antenna control unit including plural antenna terminals to which antenna elements are connected, a feeding terminal to which a high-frequency power is applied, and phase shifters which are connected to the respective antenna terminals by feeding lines that branch off from said feeding terminal and electrically change a phase of a high-frequency signal that passes through the respective antenna terminals and said feeding terminal, said phase shifters being placed at some positions on the feeding lines, wherein:

each of said phase shifters includes a hybrid coupler on a paraelectric transmission line layer that employs a paraelectric material as a base material, and a stub on a ferroelectric transmission line layer that employs a ferroelectric material as a base material;

the paraelectric transmission line layer and the ferroelectric transmission line layer are laminated through a ground conductor, and said hybrid coupler and said stub are electromagnetically connected via a coupling window that is formed on the ground conductor; and a distance between conductors that form a transmission line on the ferroelectric transmission line layer is larger than a distance between conductors that form a transmission line on the paraelectric transmission line layer.

3. A phased-array antenna that includes, on a dielectric substrate:

plural antenna elements; and an antenna control unit having a feeding terminal to which a high-frequency power is applied, and phase shifters that are connected with the respective antenna elements by feeding lines which branch off from said feeding terminal and electrically change a phase of a high-frequency signal that passes through the respective antenna elements and said feeding terminal, said phase shifters being placed at some positions on the feeding lines, wherein:

each of said phase shifters includes a hybrid coupler on a paraelectric transmission line layer that employs a paraelectric material as a base material, and a stub on a ferroelectric transmission line layer that employs a ferroelectric material as a base material;

the paraelectric transmission line layer and the ferroelectric transmission line layer are laminated through a ground conductor, and said hybrid coupler and said stub are connected via a through hole that passes through the ground conductors; and a distance between conductors that form a transmission line on the ferroelectric transmission line layer is larger than a distance between conductors that form a transmission line on the paraelectric transmission line layer.

4. The phased-array antenna of claim 3 wherein said antenna control unit includes:

said feeding terminal to which the high-frequency power is applied;

said feeding line that branches off into m pieces of lines at a k-th branch stage from said feeding terminal when $m=2^k$, where m and k are integers;

said m pieces of antenna terminals for connecting said antenna elements, which are provided on ends of said m pieces of feeding lines and arranged in a row;

said $M_k$ pieces of phase shifters, where $M_k=M_{(k-1)}\times2+2^{(k-1)}$ when $k\geqq1$ and $M_1=1$, which all have the same characteristics and electrically change a phase of the high-frequency signal that passes through said feeding line; and $M_k$ pieces of loss elements which all have the same characteristics and have a transmission loss amount that is equal to a transmission loss amount of one of said phase shifters, wherein:

said phase shifters are placed at some positions on said feeding line that branches off into m pieces of lines, such that the number of said phase shifters which are located between a (n+1)-th antenna terminal, where n is an integer that is from 1 to m−1, and said feeding terminal is one larger than the number of said phase shifters which are located between an n-th antenna terminal and the feeding terminal; and said $M_k$ loss elements are placed at some positions on said feeding line that branches off into m pieces of lines, such that the transmission loss amount from the n-th antenna terminal to said feeding terminal is larger than the transmission loss amount from the (n+1)-th antenna terminal to said feeding terminal, by a transmission loss amount corresponding to one of said phase shifters.

5. The phased-array antenna of claim 3, wherein said antenna control unit includes:

said feeding terminal to which the high-frequency power is applied;

said feeding line that branches off into m pieces of lines at a k-th branch stage from the feeding terminal when $m=2^k$, where m and k are integers;

said m pieces of antenna terminals for connecting said antenna elements, which are provided on ends of said m pieces of feeding lines and arranged in a row;

$M_k$ pieces of positive beam tilting phase shifters, where $M^k=M_{(k-1)}\times 2+2^{(k-1)}$ when $k\geqq 1$ and $M_1=1$) which all have the same characteristics and electrically change a phase of the high-frequency signal that passes through said feeding line in a positive direction; and $M_k$ pieces of negative beam tilting phase shifters which all have the same characteristics and electrically change the phase of the high-frequency signal that passes through said feeding line in a negative direction, wherein:

said positive beam tilting phase shifters are placed at some positions on said feeding line that branches off into m pieces of lines, such that the number of said positive beam tilting phase shifters which are located between an (n+1)-th antenna terminal, where n is an integer from 1 to m−1, and said feeding terminal is one larger than the number of said positive beam tilting phase shifters which are located between an n-th antenna terminal to said feeding terminal; and said negative beam tilting phase shifters are placed at some positions on said feeding line that branches off into m pieces of lines, such that the number of said negative beam tilting phase shifters which are located between an n-th antenna terminal to said feeding terminal is one larger than the number of said negative beam tilting phase shifters which are located between an (n+1)-th antenna terminal to said feeding terminal.

6. A phased-array antenna that includes, on a dielectric substrate:

plural antenna elements; and an antenna control unit having a feeding terminal to which a high-frequency power is applied, and phase shifters that are connected with the respective antenna elements by feeding lines which branch off from said feeding terminal and electrically change a phase of a high-frequency signal that passes through the respective antenna elements and said feeding terminal, said phase shifters being placed at some positions on the feeding lines, wherein:

each of said phase shifters includes a hybrid coupler on a paraelectric transmission line layer that employs a paraelectric material as a base material, and a stub on a ferroelectric transmission line layer that employs a ferroelectric material as a base material;

the paraelectric transmission line layer and the ferroelectric transmission line layer are laminated through a ground conductor, and said hybrid coupler and said stub are electromagnetically connected via a coupling window that is formed in the ground conductor; and a distance between conductors that form a transmission line on the ferroelectric transmission line layer is larger than a distance between conductors that form a transmission line on the paraelectric transmission line layer.

7. The phased-array antenna of claim 6, wherein said antenna control unit includes:

said feeding terminal to which the high-frequency power is applied;

said feeding line that branches off into m pieces of lines at a k-th branch stage from said feeding terminal when $m=2^k$, where m and k are integers;

said m pieces of antenna terminals for connecting antenna elements, which are provided on ends of said m pieces of feeding lines and arranged in a row;

said $M_k$ pieces of phase shifters, where $M_k=M_{(k-1)}\times 2+2^{(k-1)}$ when $k\geqq 1$ and $M_1=1$, which all have the same characteristics and electrically change a phase of the high-frequency signal that passes through said feeding line; and $M_k$ pieces of loss elements which all have the same characteristics and have a transmission loss amount that is equal to a transmission loss amount of one of said phase shifters, wherein:

said phase shifters are placed at some positions on said feeding line that branches off into m pieces of lines, such that the number of said phase shifters which are located between a (n+1)-th antenna terminal, where n is an integer that is from 1 to m−1, and said feeding terminal is one larger than the number of said phase shifters which are located between an n-th antenna terminal and said feeding terminal; and said loss elements are placed at some positions on said feeding line that branches off into m pieces of lines, such that the transmission loss amount from the n-th antenna terminal to said feeding terminal is larger than the transmission loss amount from the (n+1)-th antenna terminal to said feeding terminal, by a transmission loss amount corresponding to one of said phase shifters.

8. The phased-array antenna of claim 6, wherein said antenna control unit includes:

said feeding terminal to which the high-frequency power is applied;

said feeding line that branches off into m pieces of lines at a k-th branch stage from said feeding terminal when $m=2^k$, where m and k are integers;

said pieces of antenna terminals for connecting said antenna elements, which are provided on ends of said m pieces of feeding lines and arranged in a row;

$M_k$ pieces of positive beam tilting phase shifters, where $M^k=M_{(k-1)}\times 2+2^{(k-1)}$ when $k\geqq 1$ and $M_1=1$, which all have the same characteristics and electrically change a phase of the high-frequency signal that passes through said feeding line in a positive direction; and $M_k$ pieces of negative beam tilting phase shifters which all have the same characteristics and electrically change the phase of the high-frequency signal that passes through said feeding line in a negative direction, wherein:

said positive beam tilting phase shifters are placed at some positions on the feeding line that branches off into m pieces of lines, such that the number of said positive beam tilting phase shifters which are located between an (n+1)-th antenna terminal, where n is an integer from 1 to m−1, and said feeding terminal is one larger than the number of said positive beam tilting phase shifters which are located between an n-th antenna terminal to said feeding terminal; and said negative beam tilting phase shifters are placed at some positions on said feeding lines that branches off into m pieces of lines, such that the number of said negative beam tilting phase shifters which are located between an n-th antenna terminal to said feeding terminal is one larger than the number of said negative beam tilting phase shifters which are located between an (n+1)-th antenna terminal to said feeding terminal.

9. An antenna control unit including:

a feeding terminal to which a high-frequency power is applied;

a feeding line that branches off into m pieces of lines at a k-th branch stage from said feeding terminal when $m=2^k$, where m and k are integers;

m pieces of antenna terminals for connecting antenna elements, which are provided on ends of said m pieces of feeding lines and arranged in a row;

$M_k$ pieces of phase shifters, where $M_k=M_{(k-1)}\times 2+2^{(k-1)}$ when $k\geqq 1$ and $M_1=1$, which all have the same characteristics and electrically change a phase of a high-frequency signal that passes through said feeding line; and $M_k$ pieces of loss elements which all have the same characteristics and have a transmission loss amount that is equal to a transmission loss amount of one of said phase shifters, wherein:

said phase shifters are placed at some positions on said feeding line that branches off into m pieces of lines, such that the number of said phase shifters which are located between a (n+1)-th antenna terminal, where n is an integer that is from 1 to m−1, and said feeding terminal is one larger than the number of said phase shifters which are located between an n-th antenna terminal and said feeding terminal; and said loss elements are placed at some positions on said feeding line that branches off into m pieces of lines, such that the transmission loss amount from the n-th antenna terminal to said feeding terminal is larger than the transmission loss amount from the (n+1)-th antenna terminal to said feeding terminal, by a transmission loss amount corresponding to one of said phase shifters.

10. A two-dimensional antenna control unit including:

$m_2$ pieces of row antenna control units and one column antenna control unit, wherein:

said $m_2$ pieces of row antenna controls unit are said antenna control unit of claim 9 including $m=m_1$ pieces of antenna terminals, where $m_1$ is an integer;

said column antenna control unit is said antenna control unit of claim 9 including $m=m_2$ pieces of antenna terminals, where $m_2$ is an integer; and said feeding terminals of said $m_2$ pieces of row antenna control units are connected to said $m_2$ pieces of antenna terminals of said column antenna control unit, respectively.

11. A phased-array antenna that includes, on a dielectric substrate:

plural antenna elements; and an antenna control unit having a feeding terminal to which a high-frequency power is applied, and phase shifters that are connected with the respective antenna elements by feeding lines which branch off from said feeding terminal and electrically change a phase of a high-frequency signal that passes between the respective antenna elements and said feeding terminal, said phase shifters being placed at some positions on the feeding lines, wherein:

each of said phase shifters includes a hybrid coupler on a paraelectric transmission line layer that employs a paraelectric material as a base material, and a stub on a ferroelectric transmission line layer that employs a ferroelectric material as a base material;

the paraelectric transmission line layer and the ferroelectric transmission line layer are laminated through a ground conductor, and said hybrid coupler and said stub are connected via a through hole that passes through the ground conductor; and a distance between conductors that form a transmission line on the ferroelectric transmission line layer is larger than a distance between conductors that form a transmission line on the paraelectric transmission line layer;

said antenna control unit is a two-dimensional antenna control unit including $m_2$ pieces of row antenna control units and one column antenna control unit;

said $M_2$ pieces of row antenna control units are said antenna control unit of claim 9 including $m=m_1$ antenna terminals, where $m_1$ is an integer;

said column antenna control unit is said antenna control unit of claim 9 including $m=m_2$ antenna terminals, where $m_2$ is an integer; and feeding terminals of said $m_2$ row antenna control units are connected to said $m_2$ antenna terminals of said column antenna control unit, respectively.

12. A phased-array antenna that includes, on a dielectric substrate:

plural antenna elements; and an antenna control unit having a feeding terminal to which a high-frequency power is applied, and phase shifters that are connected with the respective antenna elements by feeding lines which branch off from said feeding terminal and electrically change a phase of a high-frequency signal that passes through the respective antenna elements and said feeding terminal, said phase shifters being placed at some positions on the feeding lines, wherein:

each of said phase shifters includes a hybrid coupler on a paraelectric transmission line layer that employs a paraelectric material as a base material, and a stub on a ferroelectric transmission line layer that employs a ferroelectric material as a base material;

the paraelectric transmission line layer and the ferroelectric transmission line layer are laminated through a ground conductor, and said hybrid coupler and said stub are electromagnetically connected via a coupling window that is formed in the ground conductor;

a distance between conductors that form a transmission line on the ferroelectric transmission line layer is larger than a distance between conductors that form a transmission line on the paraelectric transmission line layer;

said antenna control unit is a two-dimensional antenna control unit including $m_2$ row antenna control units and one column antenna control unit;

said $m_2$ row antenna control units are said antenna control unit of claim 9 including $m=m_1$ antenna terminals, where $m_1$ is an integer; and said column antenna control unit is said antenna control unit of claim 9 including $m=m_2$ antenna terminals, where $m_2$ is an integer; and feeding terminals of said $m_2$ row antenna control units are connected to said $m_2$ antenna terminals of said column antenna control unit, respectively.

13. An antenna control unit including:

a feeding terminal to which a high-frequency power is applied;

a feeding line that branches off into m pieces of lines at a k-th branch stage from said feeding terminal when $m=2^k$, where m and k are integers;

m pieces of antenna terminals for connecting antenna elements, which are provided on ends of said m pieces of feeding lines and arranged in a row;

$M_k$ pieces of positive beam tilting phase shifters, where $M^k=M_{(k-1)}\times 2+2^{(k-1)}$ when $k\geqq 1$ and $M_1=1$, which all have the same characteristics and electrically change a phase of a high-frequency signal that passes through said feeding line in a positive direction; and $M_k$ pieces of negative beam tilting phase shifters which all have the same characteristics and electrically change the phase of the high-frequency signal that passes through said feeding line in a negative direction, wherein:

said positive beam tilting phase shifters are placed at some positions on said feeding line that branches off into m pieces of lines, such that the number of said positive beam tilting phase shifters which are located between an (n+1)-th antenna terminal, where n is an integer from 1 to m−1, and said feeding terminal is one larger than the number of said positive beam tilting phase shifters which are located between an n-th antenna terminal to said feeding terminal; and said negative beam tilting phase shifters are placed at some positions on said feeding line that branches off into m pieces of lines, such that the number of said negative beam tilting phase shifters which are located between an n-th antenna terminal to said feeding terminal is one larger than the number of said negative beam tilting phase shifters which are located between an (n+1)-th antenna terminal to said feeding terminal.

14. A two-dimensional antenna control unit including:

$m_2$ pieces of row antenna control units and one column antenna control unit, wherein:

said $m_2$ pieces row antenna control unit are said antenna control unit of claim 13 including $m=m_1$ pieces of antenna terminals, where $m_1$ is an integer;

said column antenna control unit is said antenna control unit of claim 13 including $m=m_2$ pieces of antenna terminals, where $m_2$ is an integer; and said feeding terminals of said $m_2$ pieces of row antenna control units are connected to said $m_2$ pieces of antenna terminals of said column antenna control unit, respectively.

15. A phased-array antenna that includes, on a dielectric substrate:

plural antenna elements; and an antenna control unit having a feeding terminal to which a high-frequency power is applied, and phase shifters that are connected with the respective antenna elements by feeding lines which branch off from said feeding terminal and electrically change a phase of a high-frequency signal that passes through the respective antenna elements and said feeding terminal, said phase shifters being placed at some positions on the feeding lines, wherein:

each of said phase shifters includes a hybrid coupler on a paraelectric transmission line layer that employs a paraelectric material as a base material, and a stub on a ferroelectric transmission line layer that employs a ferroelectric material as a base material;

the paraelectric transmission line layer and the ferroelectric transmission line layer are laminated through a ground conductor, and said hybrid coupler and said stub are connected via a through hole that passes through the ground conductor;

a distance between conductors that form a transmission line on the ferroelectric transmission line layer is larger than a distance between conductors that form a transmission line on the paraelectric transmission line layer;

said antenna control unit is a two-dimensional antenna control unit including $m_2$ row antenna control units and one column antenna control unit;

said $m_2$ pieces of row antenna control units are said antenna control unit of claim 13 including $m=m_1$ antenna terminals, where $m_1$ is an integer;

said column antenna control unit is said antenna control unit of claim 13 including $m=m_2$ antenna terminals, where $m_2$ is an integer; and feeding terminals of said $m_2$ row antenna control units are connected to said $m_2$ antenna terminals of said column antenna control unit, respectively.

16. A phased-array antenna that includes, on a dielectric substrate:

plural antenna elements; and an antenna control unit having a feeding terminal to which a high-frequency power is applied, and phase shifters that are connected with the respective antenna elements by feeding lines which branch off from said feeding terminal and electrically change a phase of a high-frequency signal that passes through the respective antenna elements and said feeding terminal, said phase shifters being placed at some positions on the feeding lines, wherein:

each of said phase shifters includes a hybrid coupler on a paraelectric transmission line layer that employs a paraelectric material as a base material, and a stub on a ferroelectric transmission line layer that employs a ferroelectric material as a base material, the paraelectric transmission line layer and the ferroelectric transmission line layer are laminated through a ground conductor, and said hybrid coupler and said stub are electromagnetically connected via a coupling window that is formed in the ground conductor;

a distance between conductors that form a transmission line on the ferroelectric transmission line layer is larger than a distance between conductors that form a transmission line on the paraelectric transmission line layer;

said antenna control unit is a two-dimensional antenna control unit including $m_2$ row antenna control units and one column antenna control unit;

said $m_2$ row antenna control units are said antenna control unit of claim 13 including $m=m_1$ antenna terminals, where $m_1$ is an integer;

said column antenna control unit is said antenna control unit of claim 13 including $m=m_2$ antenna terminals, where $m_2$ is an integer; and feeding terminals of said $m_2$ row antenna control units are connected to said $m_2$ antenna terminals of said column antenna control unit, respectively.

* * * * *